US011480899B2

(12) United States Patent
Yabuki

(10) Patent No.: US 11,480,899 B2
(45) Date of Patent: Oct. 25, 2022

(54) IMAGE FORMATION APPARATUS WITH FIXATION DEVICE SPEED CONTROL

(71) Applicant: Oki Electric Industry Co., Ltd., Tokyo (JP)

(72) Inventor: Ryoji Yabuki, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/350,732

(22) Filed: Jun. 17, 2021

(65) Prior Publication Data

US 2021/0397115 A1 Dec. 23, 2021

(30) Foreign Application Priority Data

Jun. 22, 2020 (JP) ..... JP2020-107099

(51) Int. Cl.
*G03G 15/20* (2006.01)
*G03G 15/00* (2006.01)

(52) U.S. Cl.
CPC ..... *G03G 15/205* (2013.01); *G03G 15/2053* (2013.01); *G03G 15/2064* (2013.01); *G03G 15/5008* (2013.01); *G03G 2215/2038* (2013.01)

(58) Field of Classification Search
CPC ..... G03G 15/205; G03G 15/2064; G03G 15/2046; G03G 15/2042; G03G 2215/2045
See application file for complete search history.

(56) References Cited

U.S. PATENT DOCUMENTS

2005/0158066 A1* 7/2005 Tomiyori ..... G03G 15/2042 399/68

FOREIGN PATENT DOCUMENTS

JP 2019-128446 A 8/2019

* cited by examiner

*Primary Examiner* — Arlene Heredia
(74) *Attorney, Agent, or Firm* — Metrolex IP Law Group, PLLC

(57) ABSTRACT

An image formation apparatus according to an embodiment includes a fixation device and a controller. The fixation device includes: a fixation member that includes a first region and a second region located closer to a center in a longitudinal direction of the fixation member than the first region; a pressurizing member that forms a nip portion between the fixation member and the pressurizing member; first and second heat generating portions that heat the first and second regions, respectively; a first sensor that detects a first temperature of one of the pressurizing member and the fixation member at a position corresponding to the first heat generating portion; and a second sensor that detects a second temperature of the one at a position corresponding to the second heat generating portion. The controller controls a drive speed of the pressurizing member or the fixation member based on the first and second temperatures.

20 Claims, 19 Drawing Sheets

IMAGE FORMATION APPARATUS WITH FIXATION DEVICE SPEED CONTROL

CROSS REFERENCE TO RELATED APPLICATIONS

This application claims priority based on 35 USC 119 from prior Japanese Patent Application No. 2020-107099 filed on Jun. 22, 2020, entitled "IMAGE FORMATION APPARATUS", the entire contents of which are incorporated herein by reference.

BACKGROUND

The disclosure may relate to an image formation apparatus equipped with a fixation device configured to fix a developer image to a medium.

In a related art, a fixation device is provided with a fixation member to be heated by a heater and a pressurizing member forming a nip portion between the fixation member and the pressurizing member. While one of the fixation member and the pressurizing member is driven to rotate, the medium passes through the nip portion between the fixation member and the pressurizing member. With this operation, the medium is heated and pressurized in the nip portion, and thus the developer image on the medium is fixed onto the medium (see, for example, Patent Document 1: Japanese Patent Application Publication No. 2019-128446 (see FIGS. 2A and 2B)

SUMMARY

However, in the fixation device described above, a linear speed of the fixation member or the pressurizing member may fluctuate due to a temperature change or a temperature unevenness, and thus uneven printing such as color shift and rubbing may occur.

An object of an embodiment of the disclosure may be to suppress fluctuations in a linear speed of a fixation member or a pressurizing member due to a temperature change or a temperature unevenness.

An aspect of the disclosure may be an image formation apparatus that may include: a fixation device; and a controller. The fixation device includes: a fixation member that is configured to transfer heat to a medium and includes a first region and a second region that is located closer to a center in a longitudinal direction of the fixation member than the first region; a pressurizing member that forms a nip portion between the fixation member and the pressurizing member; a first heat generating portion configured to heat the first region of the fixation member; a second heat generating portion configured to heat the second region of the fixation member; a first sensor that detects a first temperature of one of the pressurizing member and the fixation member at a position corresponding to the first region in the longitudinal direction; and a second sensor that detects a second temperature of the one of the pressurizing member and the fixation member at a position corresponding to the second region in the longitudinal direction. The controller is configured to control a drive speed of the pressurizing member or the fixation member based on the first temperature and the second temperature.

According to the above-described aspect, the drive speed of the pressurizing member or the fixation member is controlled based on the first temperature and the second temperature. Therefore, fluctuation of a linear speed of the fixation member or the pressurizing member due to a temperature change or a temperature unevenness can be suppressed.

DETAILED DESCRIPTION

Figure 1:
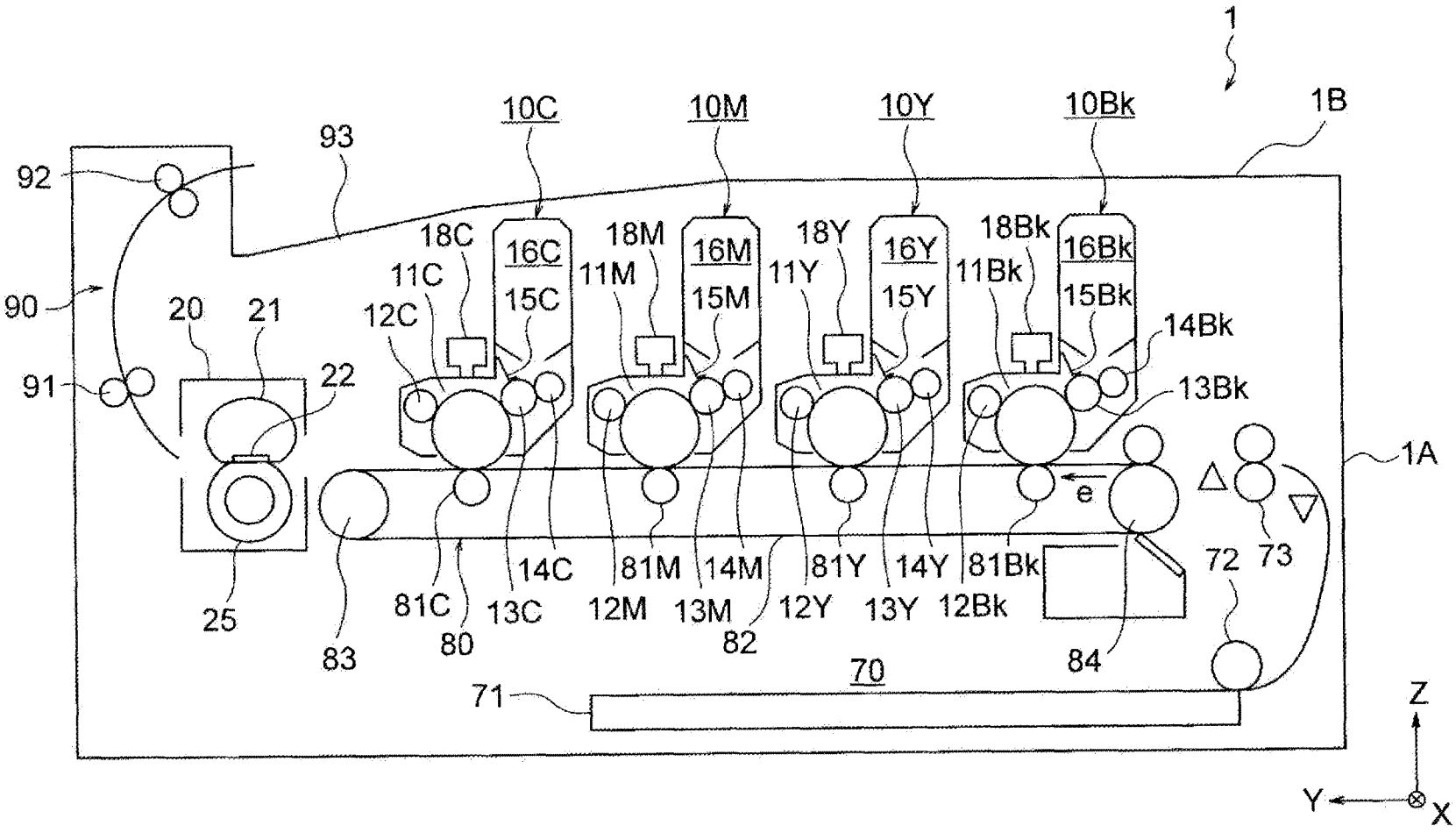
FIG. 1 is a diagram illustrating a basic configuration of an image formation apparatus according to a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

First Embodiment (Image Formation Apparatus)

First, an image formation apparatus (LED printer) according to a first embodiment is described. FIG. 1 is a diagram illustrating a view of an image formation apparatus 1. The image formation apparatus 1 is configured to form an image by an electrophotographic method, and is, for example, a color printer.

The image formation apparatus 1 includes a media supply unit 70 that supplies a medium P, process units 10Bk, 10Y, 10M, and 10C as image formation units that form toner images (developer images) of black (Bk), yellow (Y), magenta (M), and cyan (C), a transfer unit 80 that transfers the images to the medium P, a fixation device 20 that fixes the images on the medium P, and a media discharge unit 90 that discharges the medium P out of the image formation apparatus 1.

These components are housed in a housing 1A. A top cover 1B which can be opened and closed is provided at an upper part of the housing 1A.

The media supply unit 70 includes a media cassette 71 that accommodates therein media P such as printing paper or the like, a feed roller 72 that feeds the media P in the media cassette 71 one by one into a conveyance path, and a conveyance roller pair 73 that conveys the medium P fed into the conveyance path to the transfer unit 80 along the conveyance path. In addition to the printing paper, OHP (Overhead Projector) sheets, envelopes, copying paper, special paper, etc. can be used as the media P.

The process units 10Bk, 10Y, 10M, and 10C are arranged from upstream to downstream (from right to left in FIG. 1) along the conveyance path of the media P.

Each of the process units 10Bk, 10Y, 10M, and 10C includes a cylindrical photosensitive drum 11Bk, 11Y, 11M, 11C as an image carrier, a charging roller 12Bk, 12Y, 12M, 12C as a charging member that uniformly charges the surface of the photosensitive drum 11Bk, 11Y, 11M, 11C, and a development roller 13Bk, 13Y, 13M, 13C as a developer carrier that attaches toner (developer) to an electrostatic latent image on the surface of the photosensitive drum 11Bk, 11Y, 11M, and 11C to form a toner image on the photosensitive drum 11Bk, 11Y, 11M, and 11C.

In each of the process units 10Bk, 10Y, 10M, and 10C, a toner supply roller 14Bk, 14Y, 14M, and 14C serving as a supply member and a development blade 15Bk, 15Y, 15M, and 15C serving as a regulating member are provided in contact with the development roller 13Bk, 13Y, 13M, and 13C. The toner supply roller 14Bk, 14Y, 14M, 14C supplies the toner to the development roller 13Bk, 13Y, 13M, and 13C. The development blade 15Bk, 15Y, 15M, 15C regulates the thickness of the toner layer formed on the surface of the development roller 13Bk, 13Y, 13M, and 13C. In each of the process units 10Bk, 10Y, 10M, and 10C, a toner cartridge 16Bk, 16Y, 16M, 16C as a developer container that supplies toner is mounted above the toner supply roller 14Bk, 14Y, 14M, 14C.

Above the process units 10Bk, 10Y, 10M, and 10C, the exposure heads 18Bk, 18Y, 18M, and 18C as print heads are disposed so as to face the photosensitive drums 11Bk, 11Y, 11M, and 11C, respectively. The exposure heads 18Bk, 18Y, 18M, and 18C are suspended and supported by the top cover 1B.

The transfer unit 80 includes a transfer belt 82 that adsorbs and conveys the medium P, a drive roller 83 that drives the transfer belt 82, a tension roller 84 that provides tension to the transfer belt 82, and transfer rollers 81Bk, 81Y, 81M, and 81C as transfer members that are arranged opposite to the photosensitive drums 11Bk, 11Y, 11M, and 11C with the transfer belt 82. 81Bk, 81Y, 81M, and 81C therebetween. The transfer rollers 81Bk, 81Y, 81M, and 81C transfer the toner images of respective colors formed on the photosensitive drums 11Bk, 11Y, 11M, and 11C to the medium P.

The fixation device 20 includes a fixation belt 21, a heater 22, and a pressure roller 31. The heater 22 heats the fixation belt 21 from an inner circumference side of the fixation belt 21. A nip section is formed between an outer circumferential surface of the fixation belt 21 and the pressure roller 31. When the medium P passes through the nip section, the fixation device 20 applies heat and pressure to the toner image on the medium P to fix the toner image on the medium P.

The media discharge unit 90 includes a discharge roller pairs 91 and 92 that convey the medium P that has passed through the fixation device 20 and discharges the medium P from a discharge port. The top cover of the image formation apparatus 1 is formed with a stacker 93 on which the media P discharged by the discharge roller pairs 91 and 92 are stacked and accumulated.

In the following, the process units 10Bk, 10Y, 10M, and 10C are described as a process unit 10 when there is no particular need to distinguish them. Similarly, the exposure heads 18Bk, 18Y, 18M, and 18C are described as an exposure head 18 when there is no particular need to distinguish them. The photosensitive drums 11Bk, 11Y, 11M, and 11C are also described as a photosensitive drum 11 when there is no particular need to distinguish them.

In FIG. 1, an axial direction of the photosensitive drums 11Bk, 11Y, 11M, and 11C is referred to as an X direction. A direction of movement of the medium P when the medium P passes through the process units 10Bk, 10Y, 10M, and 10C is referred to as a Y direction. A direction perpendicular to the XY plane is referred to as a Z direction. The Z direction is a vertical direction, where a +Z direction is upward and a −Z direction is downward. However, these directions are intended to facilitate understanding of the configuration of the image formation apparatus 1, and do not limit the orientation of the image formation apparatus 1 in use.

<Configuration of Fixation Device>

Figure 2:
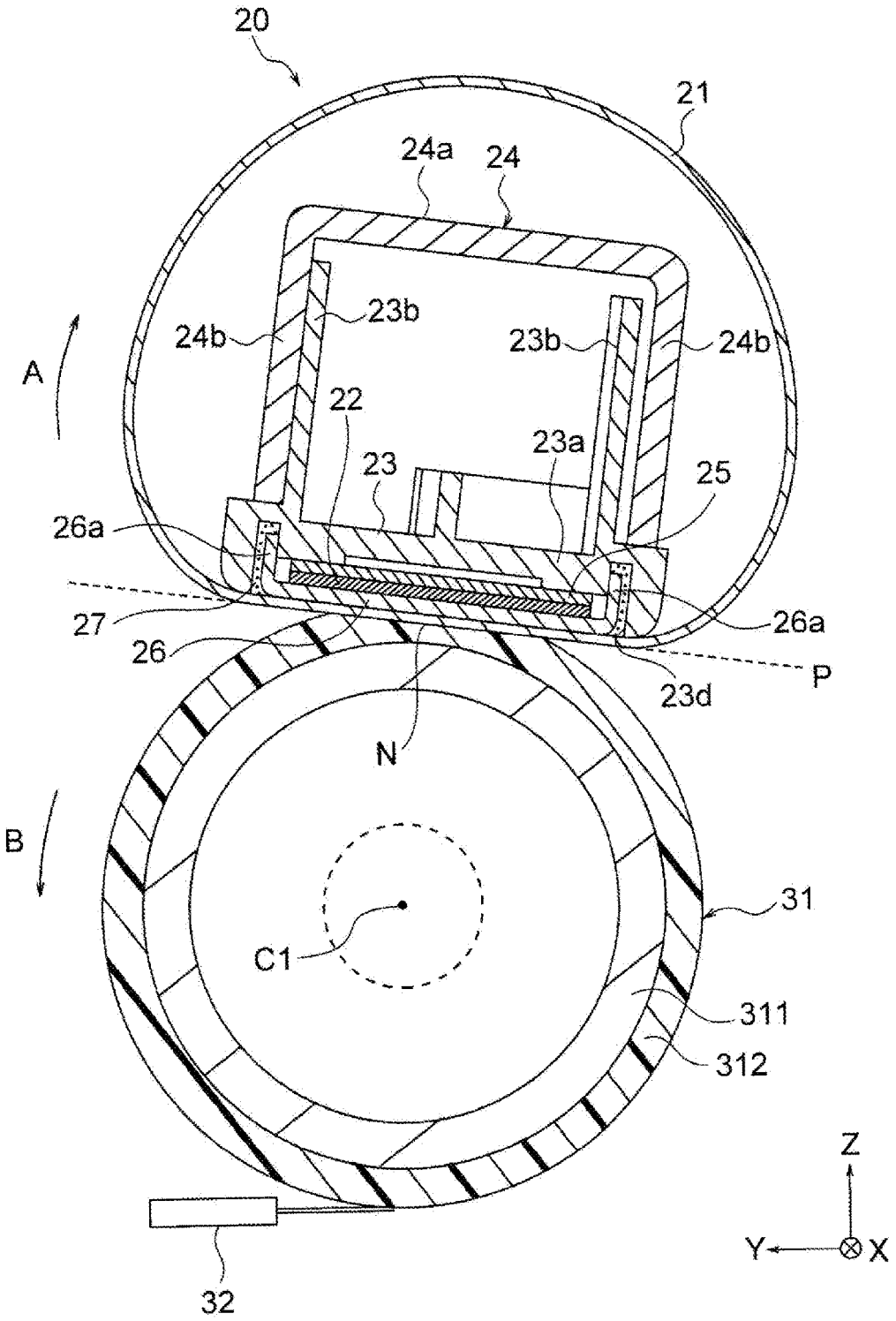
FIG. 2 is a diagram illustrating a cross-sectional view of a fixation device according to a first embodiment.
Figure 3:
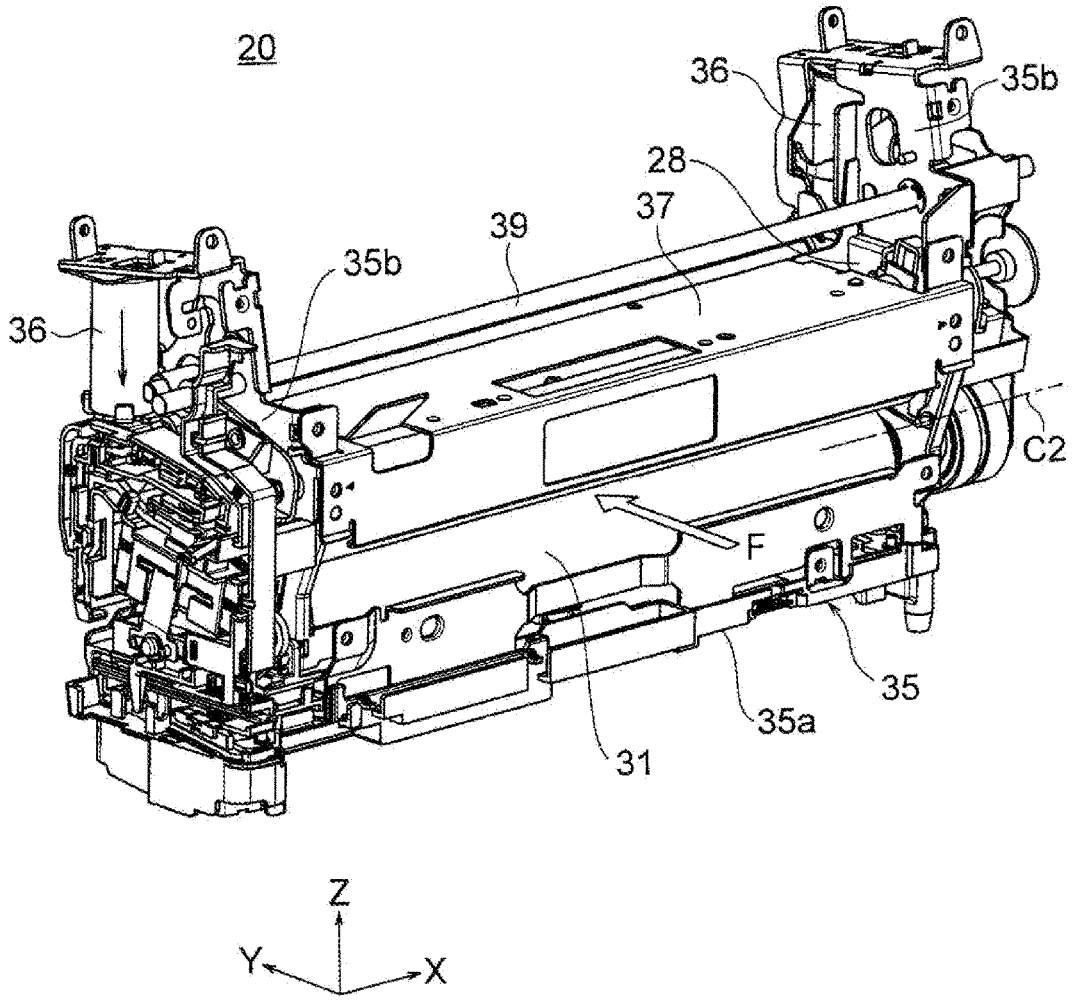
FIG. 3 is a diagram illustrating a perspective view of the fixation device according to a first embodiment.
Figure 4:
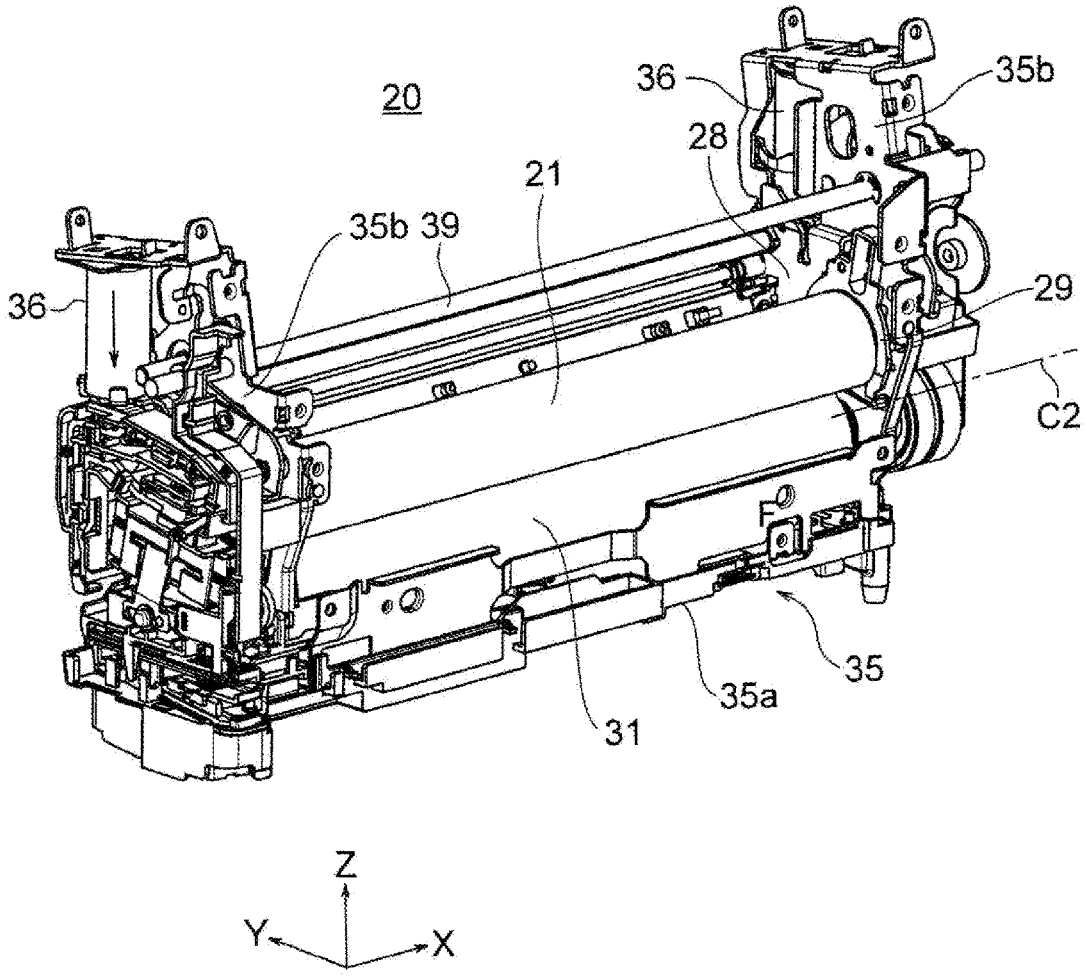
FIG. 4 is a diagram illustrating a perspective view of the fixation device according to a first embodiment.

Next, the configuration of the fixation device 20 according to a first embodiment is described. FIG. 2 is a diagram illustrating a cross-sectional view of the fixation device 20. FIG. 3 is a diagram illustrating a perspective view of the fixation device 20. FIG. 4 is a diagram illustrating a perspective view of the fixation device 20 with a top cover 37 (described later) removed therefrom.

As illustrated in FIG. 2, the fixation device 20 includes a fixation belt 21 (belt member) serving as a fixation member, a heater 22 serving as a heat generating member, a heater holder 23, a stay 24 serving as a support, a heat conduction plate 25, a separation plate 26, the pressure roller 31 serving as a pressurizing member, and a temperature detector 32 (a temperature detecting unit).

Figure 5A:
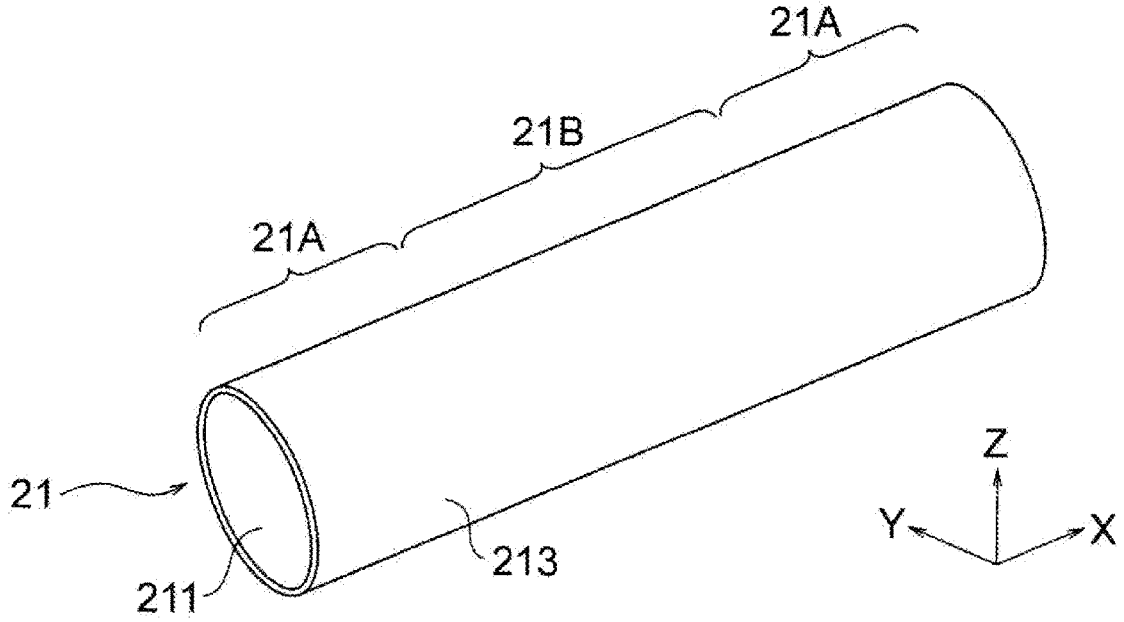
FIGS. 5A and 5B are diagrams illustrating a perspective view and a cross-sectional view of a fixation belt according to a first embodiment.
Figure 5B:
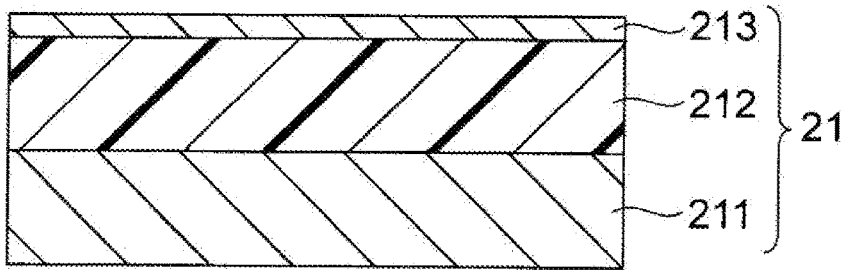

The fixation belt 21 is an endless belt and moves in a direction indicated by the arrow A. FIG. 5A is a diagram illustrating a perspective view of the fixation belt 21, and FIG. 5B is a diagram illustrating a cross-sectional view of the fixation belt 21. As illustrated in FIG. 5A, a width direction of the fixation belt 21 is the X direction. The fixation belt 21 is long in the X direction.

As illustrated in FIG. 5B, the fixation belt 21 includes a base layer 211, an elastic layer 212 formed on the surface of the base layer 211, and a surface layer 213 formed on the surface of the elastic layer 212. The base layer 211 is formed of a metal, such as stainless steel, or a resin, such as polyimide. The elastic layer 212 is formed, for example, of silicone rubber. The surface layer 213 is formed, for example, of PFA (tetrafluoroethylene perfluoroalkyl vinyl ether copolymer).

As illustrated in FIG. 2, the heater 22, the stay 24, the heater holder 23, the heat conduction plate 25, and the separation plate 26 are disposed on the inner circumference side of the fixation belt 21. The fixation belt 21 is heated from the inner circumference side by the heater 22.

Figure 6:
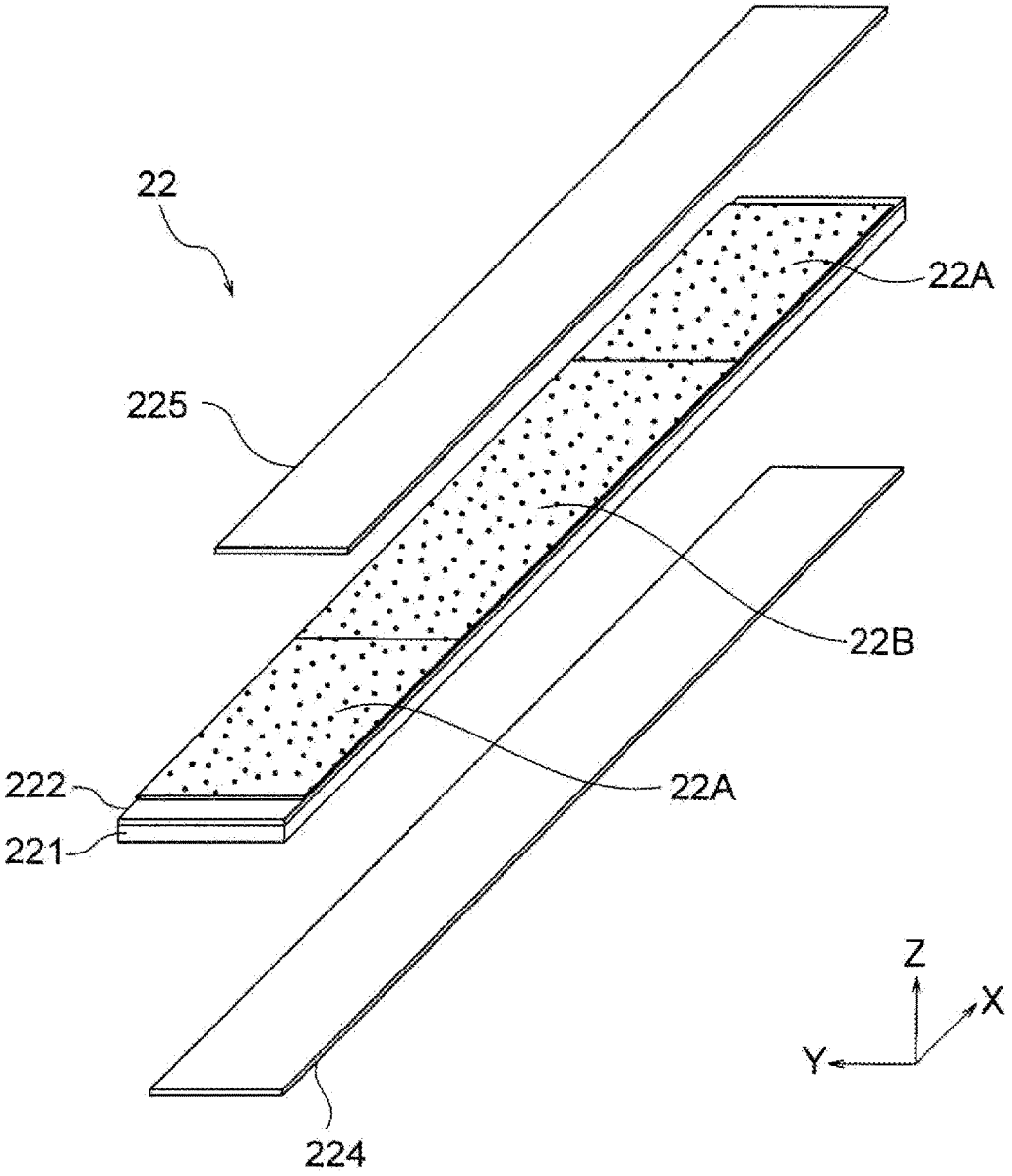
FIG. 6 is a diagram illustrating an exploded perspective view of a heater according to a first embodiment.

FIG. 6 is a diagram illustrating an exploded view of the heater 22. The heater 22 is a surface heater and is long in the X direction. The heater 22 includes a substrate 221 formed of a metal such as stainless steel and an insulating layer 222 such as a glass thin film covering the surface of the substrate 221. Two first heat generating portions (heating parts) 22A and one second heat generating portion (heating parts) 22B are formed on the surface of the insulating layer 222.

The heat generating portions 22A and 22B are electrically independent resistance heating elements formed on the surface of the insulating layer 222 on the substrate 221. The second heat generating portion 22B is formed in a middle portion (a center portion) of the substrate 221 in the X direction. The two first heat generating portions 22A are formed at both end portions of the substrate 221 in the X direction (i.e., on both sides of the second heat generating portion 22B in the X direction).

The heat generating portions 22A and 22B are electrically connected to a fixation controller 105. The heat generating portions 22A and 22B are configured to generate heat individually when an electric current is applied thereto.

In the fixation belt 21 (FIG. 5A) described above, portions that are heated by the first heat generating portions 22A are designated as first regions 21A, and a portion that is heated by the second heat generating portion 22B is designated as a second region 21B. The first region 21A is located at both end portions of the fixation belt 21 in the X-direction, and the second region 21B is located at a middle portion (a center portion) of the fixation belt 21 in the X-direction.

Returning to FIG. 2, the stay 24 is a structure supporting the heater 22, the heater holder 23, the heat conduction plate 25 and the separation plate 26. The stay 24 is formed, for example, of metal. The stay 24 has a substantially U-shaped cross section in a plane perpendicular to the X direction. More specifically, the stay 24 includes two side plate portions 24*b* opposed to each other in the Y direction and a top plate portion 24*a* connecting ends of the side plate portions 24*b* in the +Z direction.

The heater holder 23 is fixed to a portion of the stay 24 on the nip portion N side (the pressure roller 31 side) and supports the heater 22 with respect to the stay 24. The heater holder 23 is formed of a resin such as PEEK (polyetheretherketone), for example.

The heater holder 23 has two side plate portions 23*b* disposed between the two side plate portions 24*b* of the stay 24, and a bottom plate portion 23*a* connecting ends of the side plate portions 23*b* in the −Z direction. The heater 22 is attached to the bottom plate portion 23*a* of the heater holder 23 via the heat conduction plate 25.

The heat conduction plate 25 is a plate-like member disposed between the bottom plate portion 23*a* of the heater holder 23 and the heater 22. The heat conduction plate 25 is formed, for example, of stainless steel (SUS).

The separation plate 26 is a plate-like member disposed between the heater 22 and the fixation belt 21. The separation plate 26 is made of, for example, glass-coated stainless steel. The separation plate 26 diffuses the heat of the heater 22 and transfers the heat to the fixation belt 21, and has effects of equalizing the temperature distribution of the fixation belt 21 in the nip portion N.

The separation plate 26 is formed with a pair of bent portions 26*a* at both ends thereof in the Y direction. The bent portions 26*a* are respectively inserted into and fixed to grooves 23*d* of the bottom plate 23*a* of the heater holder 23. The heater 22 and the heat conduction plate 25 are held in a state sandwiched between the bottom plate portion 23*a* of the heater holder 23 and the separation plate 26.

It may be preferable to interpose a liquid lubricant 27 (e.g., lubricating oil) between the heater 22 and the inner circumferential surface of the fixation belt 21 to reduce the frictional resistance therebetween. The liquid lubricant 27 is, for example, applied to the inner circumferential surface of the fixation belt 21.

Figure 7A:
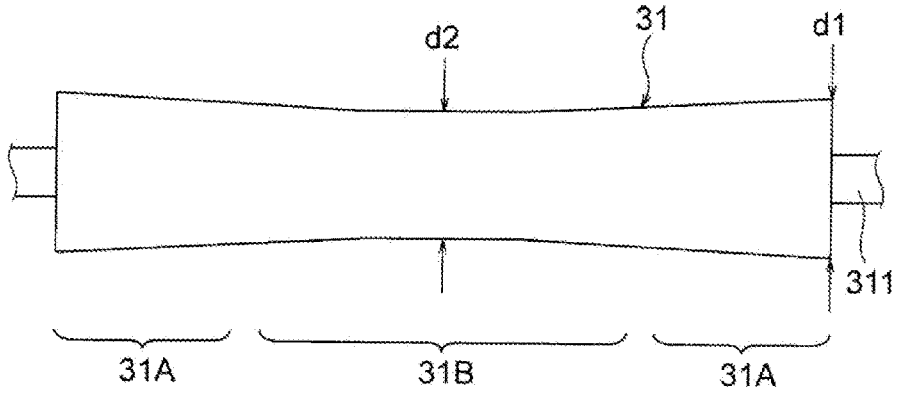
FIGS. 7A and 7B are diagrams illustrating a front view and a cross-sectional view of a pressure roller according to a first embodiment.
Figure 7B:
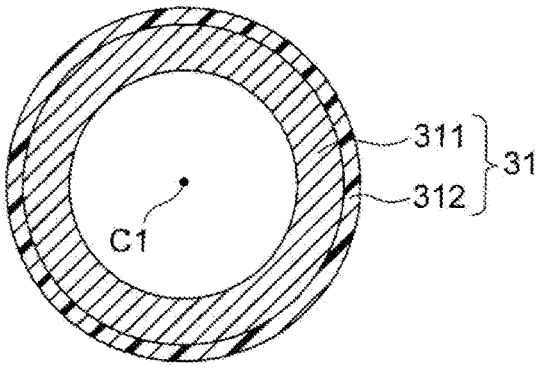

The pressure roller 31 is a roller having an axial direction in the X direction, and is supported to be rotatable about a rotation axis C1 thereof extending in the X direction. The pressure roller 31 is pressed against the heater 22 through the fixation belt 21 to form the nip portion N between the pressure roller 31 and the fixation belt FIG. 7A is a diagram illustrating a front view of the pressure roller 31. FIG. 7B is a diagram illustrating a cross-sectional view of the pressure roller 31. As illustrated in FIG. 7B, the pressure roller 31 includes a shaft 311 and an elastic layer 312 covering the surface of the shaft 311.

The shaft 311 is a base that supports the entire pressure roller 31 and is made of a metal, such as free-cutting steel (SUM). The driving force of a fixation motor 110 (FIG. 9) is transmitted to one end (axle portion) of the shaft 311 in the X direction.

The elastic layer 312 is made of silicone rubber, to which a conductive imparting agent such as carbon black is added. The surface of the elastic layer 312 may be covered with PFA tubing.

As illustrated in FIG. 7A, the pressure roller 31 has a concave crown shape (an inverted crown shape) in which the outer diameter increases as closer to both end portions of the pressure roller 31 in the X direction from the central portion of the pressure roller 31 in the X direction. That is, the equation d1>d2 is established, where the outer diameter of each end portion in the X direction of the pressure roller 31 is d1 and the outer diameter of the central portion in the X direction of the pressure roller 31 is d2. Note that in the disclosure, the concave crown shape of the pressure roller 31 means that the pressure roller 31 has the outer diameter whose a difference between the end portions thereof and the center portion thereof is greater than 0.07 mm. It may be preferable that the concave crown shape of the pressure roller 31 has the outer diameter difference of approximately 0.1 to 0.3 mm.

In the pressure roller 31, portions corresponding to the first heat generating portions 22A of the heater 22 are designated as first portions 31A, and a portion corresponding to the second heat generating portion 22B of the heater 22 is designated as a second portion 31B. The first portions 31A are located at both end portions of the pressure roller 31 in the X-direction, and the second portion 31B is located at the central portion (the middle portion) of the pressure roller 31 in the X-direction.

Figure 8:
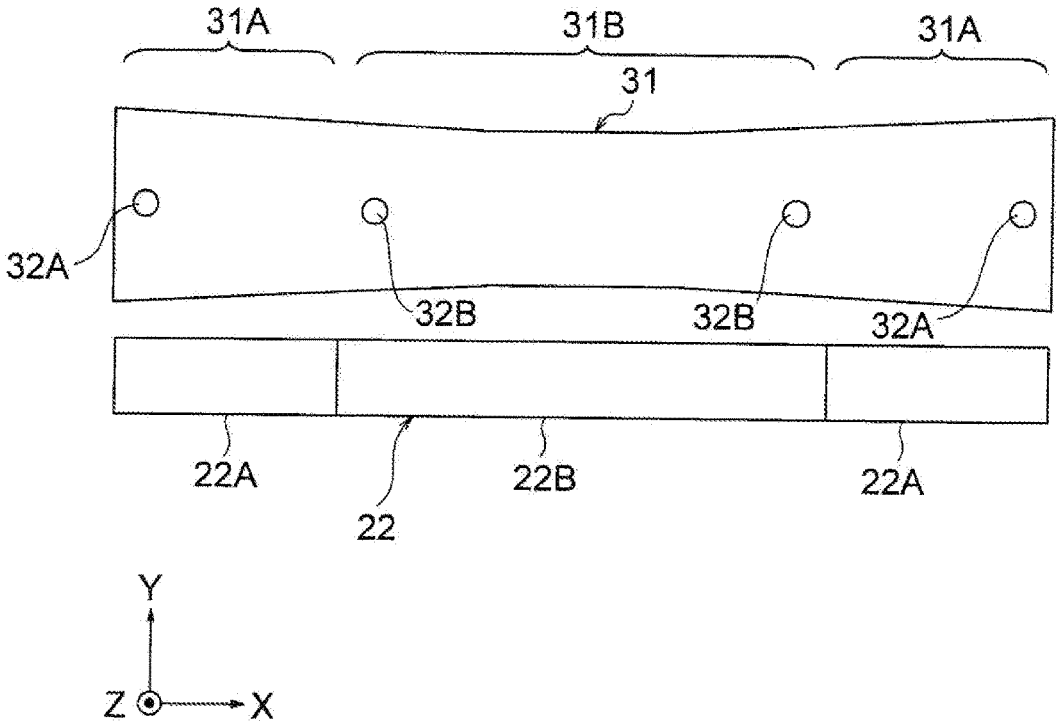
FIG. 8 is a diagram illustrating a schematic view of a positional relationship of the pressure roller, the heater, and sensors according to a first embodiment.

The temperature detector 32 (FIG. 2) detects the temperature of the surface of the pressure roller 31. FIG. 8 is a schematic diagram illustrating the positional relationship between the temperature detector 32, the pressure roller 31, and the heater 22. The temperature detector 32 includes first sensors 32A and second sensors 32B, respectively, on both sides with respect to the center of the pressure roller 31 in the X-direction. Each of the first sensors 32A and the second sensors 32B is composed of a thermistor, for example.

The first sensors 32A are disposed at both end portions of the pressure roller 31 in the X direction. That is, the first sensor 32A is disposed at an outer end portion in the X-direction of each of the first portions 31A of the pressure roller 31 (in other words, at a position corresponding to an outer end portion in the X-direction of each of the first heat generating portions 22A of the heater 22).

The second sensors 32B are disposed at both end portions of the second portion 31B of the pressure roller 31 in the X direction. In other words, the second sensors 32B are disposed at positions corresponding to outer end portions in the X-direction of the second heat generating portion 22B of the heater 22.

Figure 9:
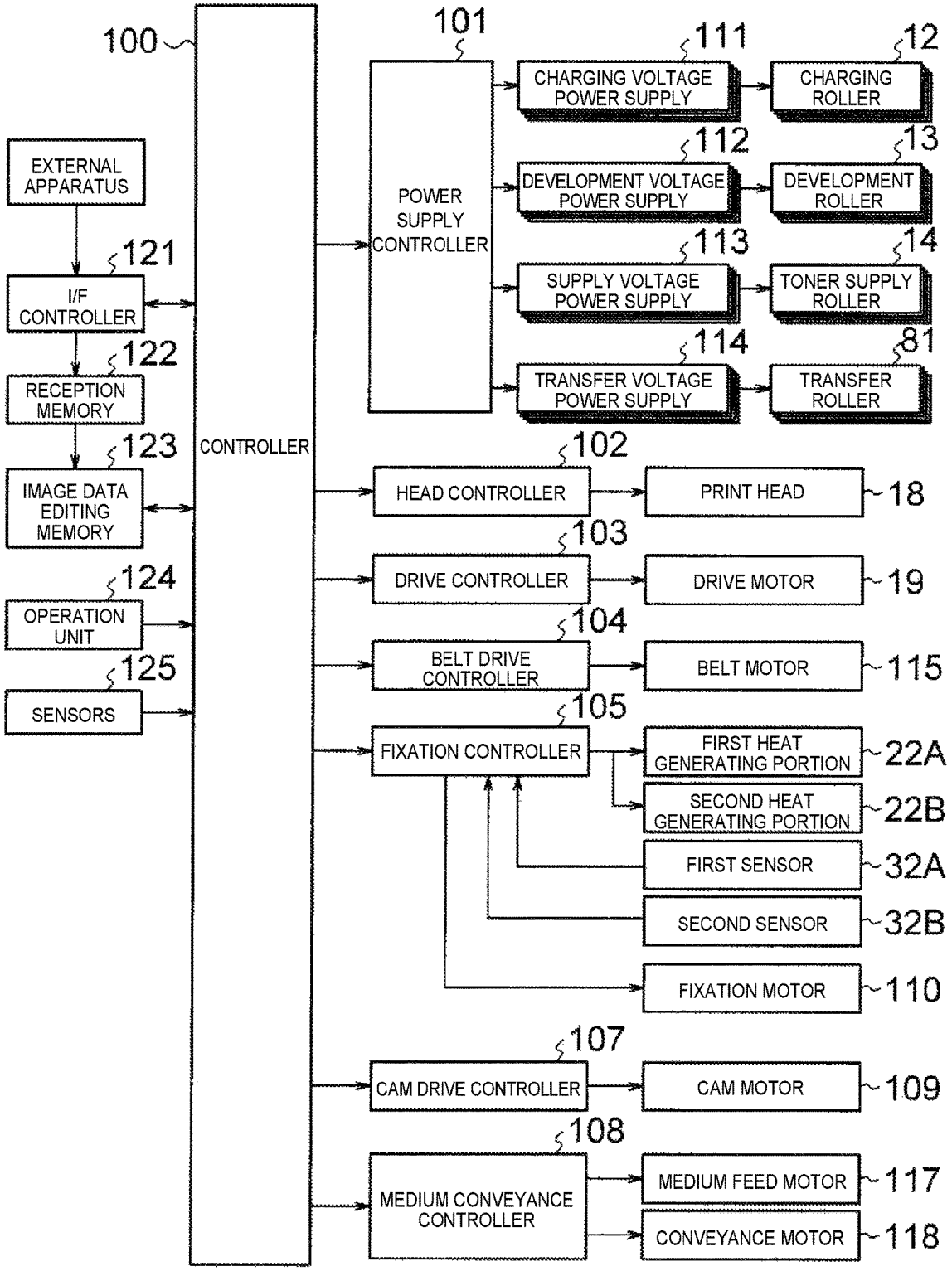
FIG. 9 is a block diagram illustrating a view of a control system of the image formation apparatus according to a first embodiment.

The first sensors 32A and the second sensors 32B detect the surface temperature of the pressure roller 31 and output detected temperature information to the fixation controller 105 (FIG. 9). In the example described above, the first sensors 32A and the second sensors 32B are thermistors, but they are not limited to thermistors and may be, for example, non-contact sensors, or the like.

Next, the structure supporting the components of the fixation device 20 is described. As illustrated in FIG. 3, the fixation device 20 includes a fixed frame 35 supporting the components of the fixation device 20 and a top cover 37 covering the fixed frame 35 from the +Z direction.

As illustrated in FIG. 4, the fixed frame 35 includes a pair of side plates 35*b* located at both ends in the X direction of the fixation device 20 and a base portion 35*a* supporting the side plates 35*b*. The pressure rollers 31 are rotatably supported by bearing portions attached to a pair of side plates 35*b*.

A pair of rotatable frames 28 (one of which is hidden by the side plate 35*b* in FIG. 4) are provided on inner sides of the pair of side plates 35*b* in the X direction. The rotatable frames 28 (pivoting frames) are mounted on the side plates 35*b* to be rotatable about a rotation axis C2 thereof extending in the X-direction with respect to the side plates 35*b*.

A substantially cylindrical flange member 29 is attached to each of the rotatable frames 28. The flange members 29 are partially inserted into the inner circumference of the fixation belt 21 at the end portions of the fixation belt 21 in the X-direction, and thus support the fixation belt 21 from the inner circumference side of the fixation belt 21.

The end portions of the stay 24 (FIG. 2) in the X-direction are fixed to the rotatable frames 28, respectively. The stay 24 and members supported by the stay 24 (the fixation belt 21, the heater 22, the heater holder 23, the heat conducting plate 25, and the separation plate 26) are supported by the pair of the rotatable frames 28.

A bias member 36 is attached to each of the side plates 35*b*. The bias member 36 is, for example, a tensile coil spring. The bias members 36 bias the rotatable frames 28 so as to rotate the rotatable frames 28 in a direction in which the fixation belt 21 is separated from the pressure roller 31.

Cams (not illustrated) are rotatably attached to the side plates 35*b* respectively and are connected to each other by a connecting shaft 39 extending in the X direction. The cams rotate by means of rotation transmission from a cam motor 109 (FIG. 9) described below.

The rotation of the cams causes the rotatable frame 28 to rotate in a first direction (in the direction in which the fixation belt 21 is separated from the pressure roller 31) or in a second direction (in a direction in which the fixation belt 21 contacts the pressure roller 31).

During the fixing operation, the fixation belt 21 contacts the pressure roller 31 to form the nip portion N (FIG. 2). To the contrary, after the completion of the fixing operation, the fixation belt 21 is separated from the pressure roller 31 to open the nip portion N.

<Control System of Image Formation Apparatus>

Next, a control system of the image formation apparatus 1 is described. FIG. 9 is a block diagram illustrating a view of the control system (control-related configuration) of the image formation apparatus 1. The image formation apparatus 1 includes a controller 100, an I/F (interface) controller 121, a reception memory 122, an image data editing memory 123, an operation unit 124, a sensor group 125, a power supply controller 101, a head controller 102, a drive controller 103, a belt drive controller 104, the fixation controller 105, a cam drive controller 107, and a medium conveyance controller 108.

The controller 100 is equipped with a microprocessor, a ROM (Read Only Memory), a RAM (Random Access Memory), input/output ports, a timer, and the like. The controller 100 receives print data and control commands from an external apparatus via the I/F controller 121, and controls the printing operation of the image formation apparatus 1.

The reception memory 122 temporarily records print data inputted from the external device via the interface controller 121. The image data editing memory 123 receives the print data recorded in the reception memory 122, and records image data which is generated by editing and processing the print data.

The operation unit 124 is provided with a display section (e.g., an LED) for displaying a status of the image formation apparatus 1 and an operation section (e.g., a switch) for an operator to input instructions. The sensor group 125 includes various sensors for monitoring the operational state of the image formation apparatus 1, such as a media position sensor, a temperature and humidity sensor, a density sensor, and the like.

The power supply controller 101 controls a charging voltage power supply 111 that applies a charging voltage to the charging roller 12, a development voltage power supply 112 that applies a development voltage to the development roller 13, a supply voltage power supply 113 that applies a supply voltage to the supply roller 14, and a transfer voltage power supply 114 that applies a transfer voltage to the transfer roller 81.

The head controller 102 transmits the image data recorded in the image data editing memory 123 to the exposure head 18 to control the light emission of the exposure head 8.

The drive controller 103 controls to drive the drive motor 19 that rotates the photosensitive drum 11 of each of the process units 10. The belt drive controller 104 controls to drive the belt motor 115 that rotates the drive roller 83.

The fixation controller 105 includes a temperature control circuit and controls the supply of an electric current(s) to the first heat generating portions 22A and the second heat generating portion 22B based on the output signals of the first sensors 32A and the second sensors 32B of the fixation device 20. In addition, the fixation controller 105 controls to drive the fixation motor 110 as a driver that rotates the pressure roller 31. The discharge roller pairs 91 and 92 are driven to rotate by the fixation motor 110.

The cam drive controller 107 controls to drive the cam motor 109 that rotates the cams. This causes the rotatable frame 28 (FIG. 4) to rotate, and the fixation belt 21 moves in the direction of approaching or separating from the pressure roller 31.

The medium conveyance controller 108 controls to drive a medium feed motor 117 that rotates the feed roller 72 and a conveyance motor 118 that rotates the conveyance roller pair 73.

(Operation of Image Formation Apparatus)

Next, the operation of the image formation apparatus 1 is described with reference to FIGS. 1 and 9. When the controller 100 of the image formation apparatus 1 receives a print command and print data from an external apparatus via the UF controller 121, the image forming operation is started. The controller 100 temporarily records the print data in the reception memory 122, edits and processes the recorded print data to generate image data, and records the image data in the image data editing memory 123.

The controller 100 also drives the medium feed motor 117 and the conveyance motor 118 by the medium conveyance controller 108. As a result, the feed roller 72 feeds the medium P in the media cassette 71 to the conveyance path, and the conveyance roller pair 73 conveys the medium P to the transfer unit 80 along the conveyance path.

In the transfer unit 80, the transfer belt 82 runs by rotation of the drive roller 83, and the transfer belt 82 adsorbs and holds the medium P and conveys the medium P along the conveyance path. The medium P passes through the process units 60K, 60C, 60M, and 60Y in this order.

The controller 100 performs formation of toner images of respective colors in the process units 10Bk, 10Y, 10M, and 10C. That is, the controller 100 controls the charging voltage power supply 111, the development voltage power supply 112 and the supply voltage power supply 113 of each process unit 10, to apply the charging voltage, the developing voltage and the supply voltage to the charging roller 12, the developing roller 13 and the supply roller 14, respectively.

The controller 100 controls the drive controller 103 to rotate the drive motor 19 to rotate each photosensitive drum 11. Along with the rotation of the photosensitive drum 11, the charging roller 12, the development roller 13 and the supply roller 14 also rotate. The charging roller 12 uniformly charges the surface of the photosensitive drum 11.

The controller 100 further controls the head controller 102 to emit lights based on the image data recorded in the image data editing memory 123. The head controller 102 emits lights to the surfaces of the photosensitive drums 11 to form electrostatic latent images on the surfaces of the photosensitive drum 11, by using the exposure heads 18.

In each process unit, the electrostatic latent image formed on the surface of the photosensitive drum 11 is developed by the toner attached to the development roller 64, and thus a toner image is formed on the surface of the photosensitive drum 11. When the toner image on the photosensitive drum 11 approaches the surface of the transfer belt 82 by rotation of the photosensitive drum 11, the controller 100 applies a transfer voltage to the transfer roller 81 by the transfer voltage power supply 114. As a result, the toner image formed on the photosensitive drum 11 is transferred to the medium P on the transfer belt 82.

In this way, the toner images of the respective colors formed by the process units 60K, 60C, 60M, and 60Y are sequentially transferred and thus superposed onto the medium P. The medium P onto which the toner images of the respective colors have been transferred is further conveyed by the transfer belt 82 and reaches the fixation device 75.

In the fixation device 20, the fixation controller 105 drives the fixation motor 110 at the start of the image forming operation, which rotates the pressure roller 31. By the temperature control of the fixation controller 105, the heater 22 is heated to a predetermined fixing temperature. The medium P conveyed from the transfer unit 80 to the fixation device 20 is heated and pressurized when passing through the nip portion N between the fixation belt 21 and the pressure roller 31, and the toner images are fixed to the medium P.

The medium P on which the toner images have been fixed is discharged by the discharge roller pairs 91 and 92 to the outside of the image forming apparatus 1 and loaded on a stacker section 93. This completes the formation of the color image on the medium P.

(Rotation Speed Compensation of Fixation Motor)

Figure 10:
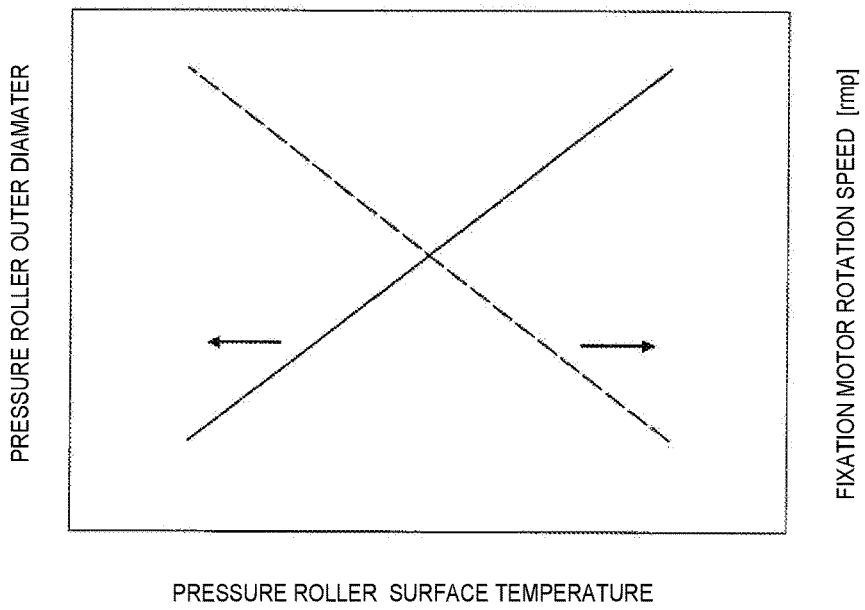
FIG. 10 is a diagram illustrating a relationship between a surface temperature of the pressure roller and an outer diameter and a rotation speed of the pressure roller according to a first embodiment.

Next, correction of the rotation speed of the fixation motor 110 (driver) in the fixation device 20 is described. FIG. 10 is a schematic diagram illustrating a relationship between the surface temperature of the pressure roller 31, the outer diameter of the pressure roller 31, and the rotation speed (drive speed) of the fixation motor 110.

The rotation of the pressure roller 31 is controlled by the fixation motor 110. Assuming that the rotation speed of the fixation motor 110 is constant, the surface velocity (linear speed) of the pressure roller 31 increases as the outer diameter of the pressure roller 31 increases due to the thermal expansion, as illustrated in FIG. 10.

When the surface speed of the pressure roller 31 changes, the speed of the medium P passing through the nip portion N also changes, and thus the passing speed of the medium P (paper-passing speed) in the fixation device 20 also changes. If the passing speed of the medium P in the fixation device 20 is too fast, the medium P while passing through the process units 10Bk, 10Y, 10M, and 10C would be pulled forward (in the conveyance direction of the medium P).

In a case where the medium P is pulled forward by the fixation device 20, the yellow toner image may be transferred to the medium P more rearwardly than the black toner image when the yellow toner image is transferred to the medium P by the process unit 10Y after the black toner image is transferred to the medium P by the process unit 10Bk. The same phenomenon occurs for magenta and cyan toner images. An image defect in which the position of the toner image of each color shifts in this manner is called a color shift.

If the passing speed of the medium P in the fixation device 20 is too slow, slack of the medium P is caused between the fixation device 20 and the process unit 10C. When the slackened medium P comes into contact with the photosensitive drum 11C, and rubbing may occur in which the toners adhered to the medium P are rubbed.

Therefore, in a first embodiment, in order to reduce image defects such as color shifts and rubbing, the rotation speed of the fixation motor 110 (i.e., the drive speed of the pressure roller 31) is corrected according to the surface temperature of the pressure roller 31.

That is, as illustrated by the dashed line in FIG. 10, the rotation speed of the fixation motor 110 is decelerated as the surface temperature of the pressure roller 31 becomes higher, and the rotation speed of the fixation motor 110 is accelerated as the surface temperature of the pressure roller 31 becomes lower. By correcting the rotation speed of the fixation motor 110, the fluctuation of the surface speed (linear speed) of the pressure roller 31 is suppressed.

Here, the pressure roller 31 has the concave crown shape and the outer diameter is not constant. The passing speed of the medium P in the fixation device 20 depends on the largest outer diameter of the pressure roller 31. Therefore, it is preferable that the rotation speed of the fixation motor 110 is corrected based on the temperature of the largest outer diameter portion of the pressure roller 31.

The fixation device 20 has two fixation modes for a wide medium P1 (a wide width medium) and a narrow medium P2 (a narrow width medium). The wide medium P1 is, for example, A4 size printing paper, and the narrow medium P2 is, for example, a postcard.

Figure 11:
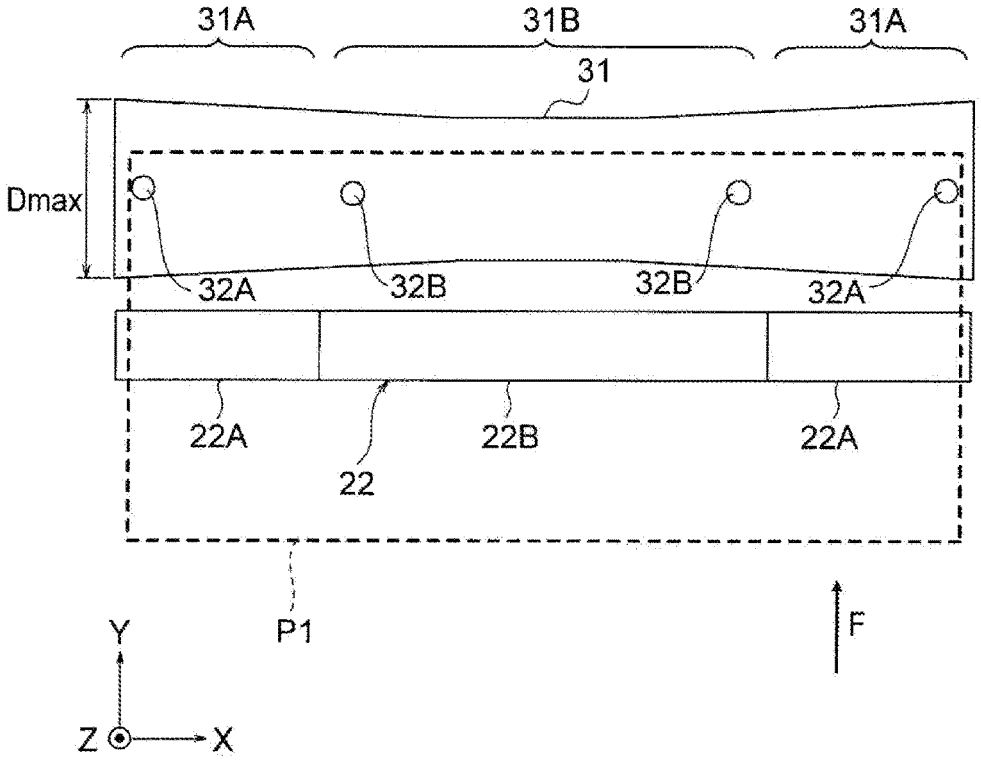
FIG. 11 is a diagram illustrating a schematic view of distribution of the outer diameter of the pressure roller in a fixation mode for a wide medium according to a first embodiment.

FIG. 11 is a diagram illustrating a schematic view of a relationship between the wide medium P1, the heater 22, the pressure roller 31 and the sensors 32A and 32B. When performing the fixing operation on the wide medium P1 (when the medium P is the wide medium P1), both the second heat generating portion 22B and the first heat generating portions 22A of the heater 22 (i.e., the entire heater 22) are heated.

In this case, the pressure roller 31 is heated evenly over the entire area thereof in the X direction. Accordingly, the outer diameter of the pressure roller 31 is greatest at both end portions of the pressure roller 31 in the X direction. Therefore, when performing the fixing operation on the wide medium (when the medium P is the wide medium P1), the rotation speed of the fixation motor 110 is corrected based on the detection temperature of the first sensors 32A.

Figure 12:
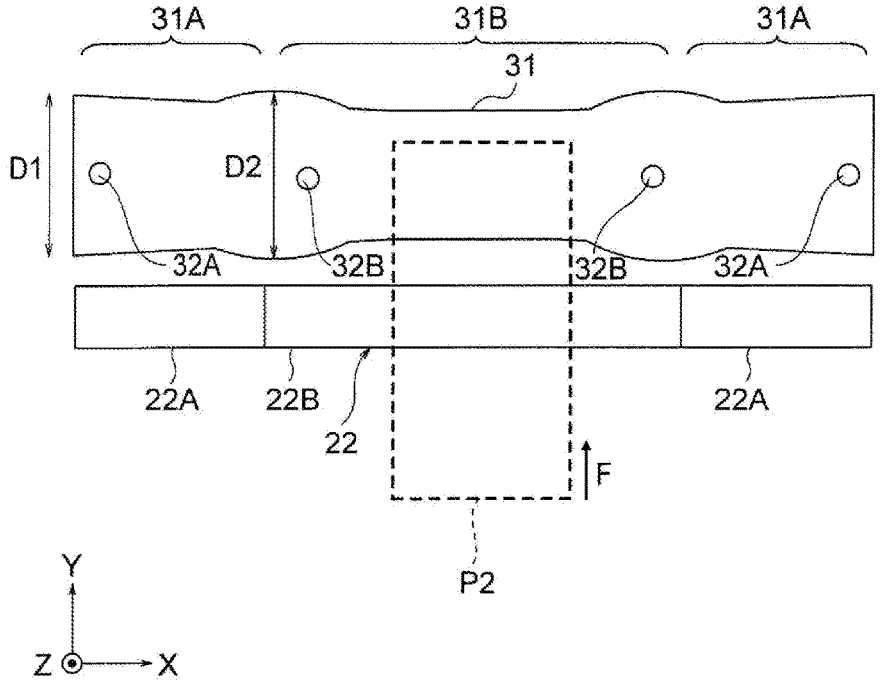
FIG. 12 is a diagram illustrating a schematic view of distribution of the outer diameter of the pressure roller in a fixation mode for a narrow medium according to a first embodiment.

FIG. 12 is a diagram illustrating a schematic view of a relationship between the narrow medium P2, the heater 22, the pressure roller 31, and the sensors 32A and 32B. When performing the fixing operation on the narrow medium P2 (when the medium P is the narrow medium P2), only the second heat generating portion 22B of the heater 22 (i.e., only the central portion of the heater 22) is heated.

In this case, both end portions in the X-direction of the second portion 31B of the pressure roller 31 (i.e., both outer sides with respect to the narrow medium P2 in the X-direction) directly contact the second heat generating portion 22B of the heater 22. Therefore, in the pressure roller 31, both end portions of the second portion 31B in the X direction are heated the most. Accordingly, the outer diameter of the pressure roller 31 may be greatest at both end portions of the second portion 31B in the X direction, as illustrated in FIG. 12.

Figure 13:
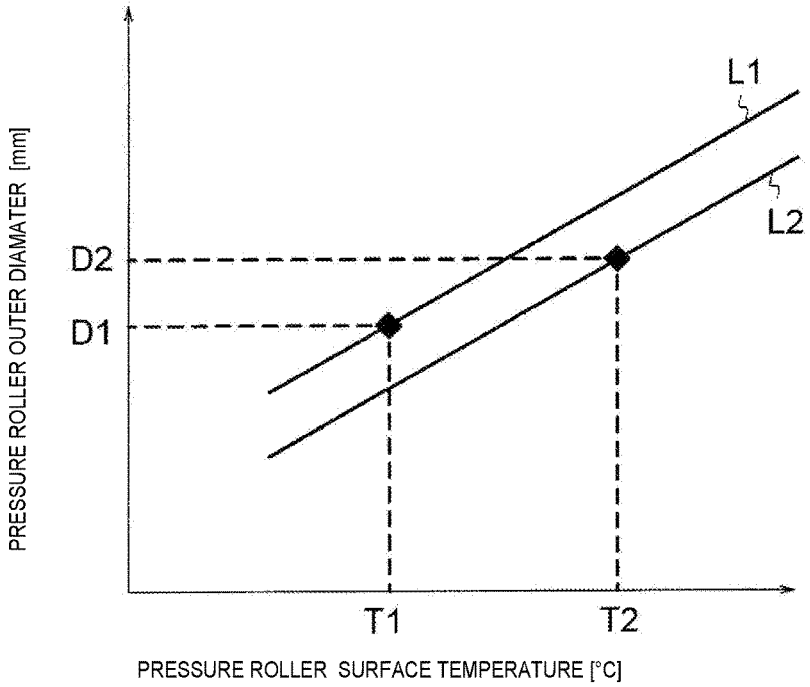
FIG. 13 is a graph illustrating a relationship between the surface temperature of the pressure roller and the outer diameter of the pressure roller according to a first embodiment.

FIG. 13 is a graph illustrating a relationship between the surface temperature of the pressure roller 31 and the outer diameters of the first portion 31A and the second portion 31B when performing the fixing operation on the narrow medium P2. The straight line L1 indicates a relationship between the temperature detected by the first sensors 32A and the largest outer diameter D1 of the first portion 31A. The straight line L2 indicates a relationship between the temperature detected by the second sensors 32B and the largest outer diameter D2 of the second portion 31B. Since the pressure roller 31 has the concave crown shape, the straight line L2 is located lower than the straight line L1.

When the medium P is the narrow medium P2, both end portions of the second portion 31B in the X direction are particularly (most) heated as described above. As illustrated in FIG. 13, if the detection temperature T2 by the second sensors 32B is higher than the detection temperature T1 by the first sensors 32A and the temperature difference (T2−T1) is greater than a predetermined temperature difference (a threshold value), the largest outer diameter D2 of the second portion 31B is larger than the largest outer diameter D1 of the first portion 31A, due to the thermal expansion. That is, the outer diameter of the pressure roller 31 is the largest at both end portions of the second portion 31B in the X direction due to the thermal expansion.

Therefore, when performing the fixing operation on the narrow medium P2, if the temperature difference (T2−T1) is less than the threshold value, the rotation speed of the fixation motor 110 is corrected based on the detection temperature of the first sensors 32A, and if the temperature difference (T2−T1) is greater than the threshold value, the rotation speed of the fixation motor 110 is corrected based on the temperature of the second sensors 32B. The threshold value is determined by the shape and thermal expansion characteristics of the pressure roller 31, and is set based on experiments beforehand. The threshold value may be zero.

Next, an example of a control method of the rotation speed of the fixation motor 110 is described. The fixation controller 105 (FIG. 9) drives the fixation motor 110 using an inverter. In an embodiment, the rotation speed of the fixation motor 110 is controlled by the timer value of the pulses that drive switching elements of the inverter.

Figure 14:
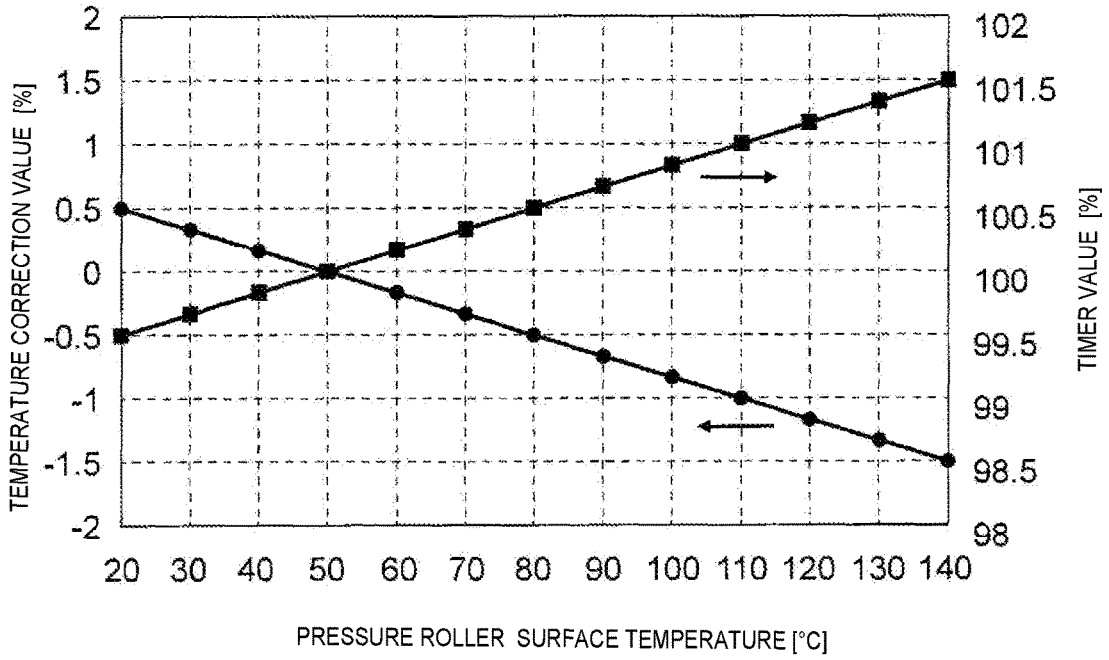
FIG. 14 is a diagram illustrating a relationship of a surface temperature of the pressure roller, a correction value of a rotation speed of a fixation motor, and a timer value for control of the fixation motor according to a first embodiment.

FIG. 14 is a graph illustrating a relationship of the surface temperature (° C.) of the pressure roller 31 and the timer value (%) and the correction value (%) of the rotation speed of the fixation motor 110. In the example illustrated in FIG. 14, the rotation speed of the fixation motor 110 at which the surface temperature of the pressure roller 31 is 50° C. is used as a reference speed.

For example, when the surface temperature of the pressure roller 31 rises to 80 [° C.], the timer value for driving the fixation motor 110 is corrected from the reference value (100%) to 100.5%, thereby decelerating the rotation speed of the fixation motor 110 by 0.5% from the reference speed.

When the surface temperature of the pressure roller 31 drops to 50° C., the timer value for driving the fixation motor 110 is corrected from the reference value to 100%, thereby correcting the rotation speed of the fixation motor 110 from the reference speed.

The correction of the rotation speed of the fixation motor 110 based on the surface temperature of the pressure roller 31 is performed at constant intervals (e.g., 100 msec cycle) while the fixing operation is continued. By correcting the rotation speed of the fixation motor 110 in accordance with the surface temperature of the pressure roller 31 in this manner, fluctuations in the surface speed of the pressure roller 31 can be suppressed and the above-described image defects can be prevented.

The amount of correction of the rotation speed of the fixation motor 110 for the change in the surface speed of the pressure roller 31 can be determined in advance by conducting thermal expansion tests on the pressure roller 31. Next, the thermal expansion tests are explained.

In the thermal expansion tests, the pressure roller 31 having a minimum outer diameter (outer diameter at the central portion in the X direction) of 40 mm and a length in the X direction of the roller portion of 200 mm is used. The shaft 311 (FIG. 7B) of the pressure roller 31 is composed of SUM, and the elastic layer 312 is composed of silicone rubber having a thickness of 4 mm and coated with a PFA tube having a thickness of 30 μm. The hardness (Asker C) of the elastic layer 312 is set to 59±3.

Five of these pressure rollers 31 are prepared, set in electric furnaces, and heated at 70° C., 100° C., 130° C., 160° C., and 190° C., respectively, for one hour. Thereafter, the outer diameter is measured at five locations in the X direction of each pressure roller 31 using a laser length measuring machine "LS-9120M" (manufactured by Keyence Corporation).

Figure 15A:
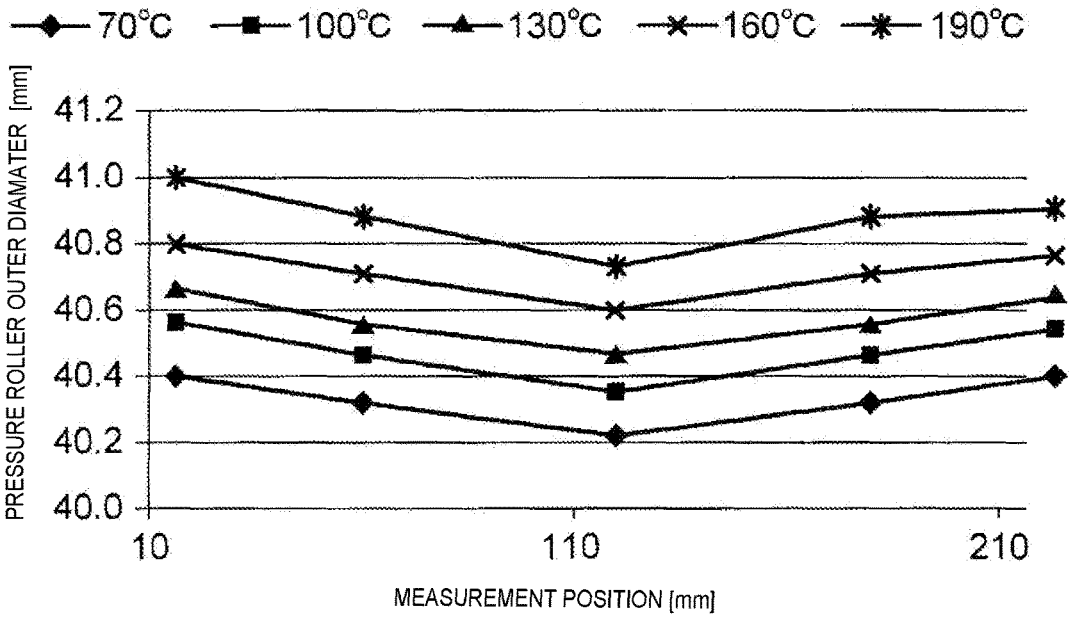
FIGS. 15A and 15B are graphs illustrating results of thermal expansion tests on the pressure roller.

FIG. 15A is a graph illustrating results of the heating expansion tests. The horizontal axis in FIG. 15A indicates the position [mm] at the pressure roller 31 in the X-direction, and the vertical axis in FIG. 15A indicates the outer diameter [mm] of the pressure roller 31. As illustrated in FIG. 15A, as the heating temperature increases to 70° C., 100° C., 130° C., 160° C., and 190° C., the outer diameters of the five locations in the X direction of the pressure roller 31 all increase.

Figure 15B:
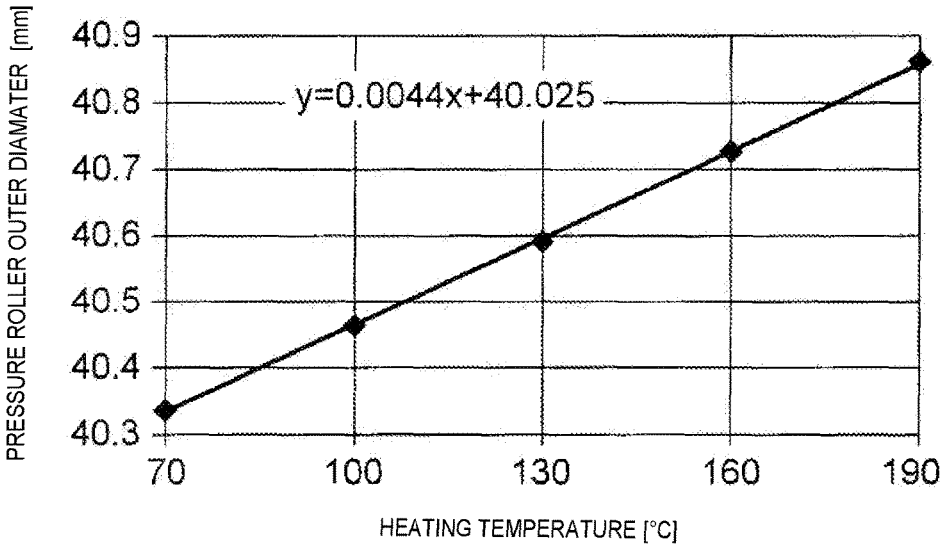

FIG. 15B is a graph illustrating a relationship between the heating temperature and the outer diameter of the pressure roller 31. The horizontal axis in FIG. 15B indicates the heating temperature (° C.), and the vertical axis in FIG. 15B indicates the outer diameter of the pressure roller 31 (mm). The outer diameter indicated in the vertical axis in FIG. 15B is the average of the outer diameters of the five locations of the pressure roller 31 illustrated in FIG. 15A for each of the heating temperatures.

As illustrated in FIG. 15B, the relationship between the heating temperature (° C.) and the outer diameter (mm) of the pressure roller 31 is represented by a linear function of $y=0.0044x+40.025$. Based on the first-order function obtained from the heating expansion tests, the correction value of the rotation speed of the fixation motor 110 for the change in the surface temperature of the pressure roller 31 is determined.

(Operation of Fixation Device)

Next, the operation of the fixation device 20 is described. When the power supply of the image formation apparatus 1 is turned on, the controller 100 drives the cam motor 109 via the cam drive controller 107. This causes the rotatable frame 28 to rotate so as to form the nip portion N between the fixation belt 21 and the pressure roller 31. This enables the fixing operation by the fixation device 20.

Figure 16:
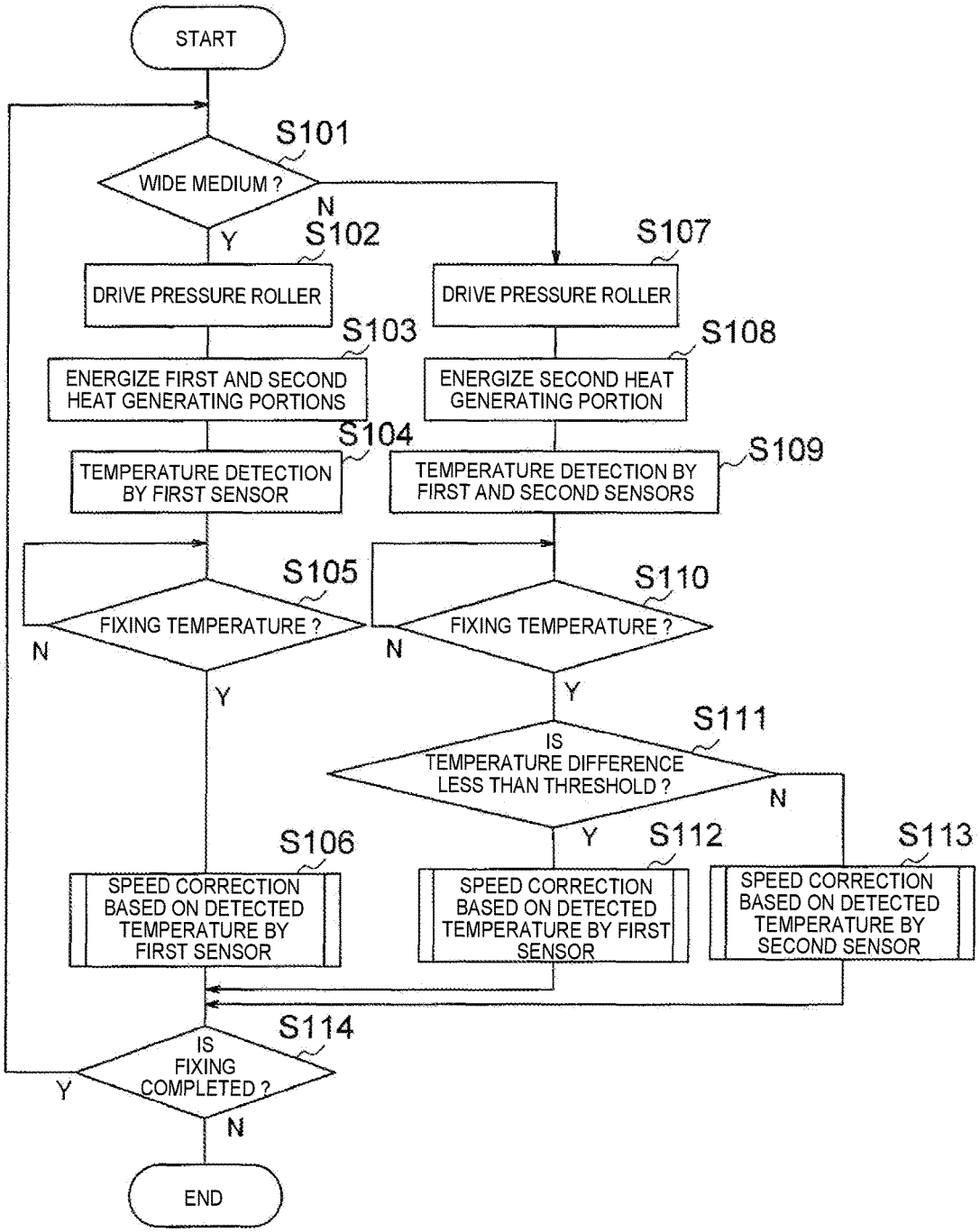
FIG. 16 is a flowchart illustrating a fixing operation according to a first embodiment.

FIG. 16 is a flowchart illustrating an operation of the fixation device 20. Each of processes illustrated in the flowchart of FIG. 16 is performed by the controller 100 as part of the image forming operation by the image formation apparatus 1.

When the image forming operation by the image formation apparatus 1 is started, the controller 100 determines whether the medium P is a wide medium P1 or a narrow medium P2 according to size information of the medium P inputted from the operation unit 124 (S101).

When performing the fixing operation on the wide medium P1 (Y in step S101), the process proceeds to step S102 and the controller 100 drives the fixation motor 110 via the fixation controller 105 (step S102). By driving the fixation motor 110, the pressure roller 31 rotates. Along with the rotation of the pressure roller 31, the fixation belt 21, which is in contact with the pressure roller 31, also rotates.

Next, the controller 100 heats the first heat generating portion 22A and the second heat generating portion 22B of the heater 22 via the fixation controller 105 (step S103). The heat of the heater 22 is transmitted to the nip portion N through the fixation belt 21.

Next, the controller 100 detects the surface temperature of the pressure roller 31 by the first sensors 32A (step S104).

When the detection temperature by the first sensors 32A reaches the predetermined fixing temperature (step S105), the controller 100 performs a correction of the rotation speed of the fixation motor 110 based on the detection temperature of the first sensors 32A (step S106).

That is, the controller 100 detects, for example, the detection temperature of the first sensors 32A in a 100 msec cycle, and corrects the timer value of the pulses that drive the switching elements of the inverter based on the detection temperature of the first sensors 32A.

The method of correcting the timer value is as explained with reference to FIGS. 14 and 15. When the detection temperatures of the two first sensors 32A are different, the correction of the rotation speed of the fixation motor 110 is performed based on higher one of the different detection temperatures.

As a result, the rotation speed of the fixation motor 110 is corrected to the rotation speed corresponding to the surface temperature of the first portion 31A (the portion having the largest outer diameter) of the pressure roller 31. The correction of the rotation speed of the fixation motor 110 is performed until the completion of the fixing operation (step S114).

On the other hand, when performing the fixing operation on the narrow medium P2 (N in step S101), the controller 100 drives the fixation motor 110 via the fixation controller 105 (step S107), and then heats the second heat generating portion 22B of the heater 22 (step S108).

Next, the controller 100 detects the surface temperature of the pressure roller 31 by the first sensors 32A and the second sensors 32B (step S109).

After the detection temperature of the first sensors 32A and the detection temperature of the second sensors 32B reach the predetermined fixing temperature (step S110), the controller 100 determines whether the difference between the detection temperature of the first sensors 32A and the detection temperature of the second sensors 32B is less than the threshold value (step S111).

If the difference (T2−T1) between the detection temperature of the first sensors 32A and the detection temperature of the second sensors 32B is less than the threshold value (Y in step S111), the thermal expansion of the second portion 31B is small and thus both end portions (first portions 31A) of the pressure roller 31 in the X direction have the largest outer diameter of the pressure roller 31.

Thus, the controller 100 acquires the detection temperature of the first sensors 32A, for example, in the 100 msec cycles, and corrects the timer value of the pulses that drive the switching elements of the inverter based on the detection temperature of the first sensors 32A (step S112). When the detection temperatures of the two first sensors 32A are different, the correction of the rotation speed of the fixation motor 110 is performed based on higher one of the different detection temperatures.

As a result, the rotation speed of the fixation motor 110 is corrected to the rotation speed corresponding to the surface temperature of the first portions 31A (the portions having the largest outer diameter) of the pressure roller 31. The correction of the rotation speed in step S112 is performed until the completion of the fixing operation (step S114).

On the other hand, if the difference (T2−T1) between the detection temperature of the first sensors 32A and the detection temperature of the second sensors 32B is greater than the threshold value (N in step S110), the thermal expansion of the second portion 31B is large, and thus the second portion 31B of the pressure roller 31 has the largest outer diameter of the pressure roller 31 due to the thermal expansion of the second portion 31B.

Thus, the controller 100 obtains the detection temperature of the second sensors 32B, for example, in the 100 msec cycles, and corrects the timer value of the pulses that drive the switching elements of the inverter based on the detected temperature of the second sensors 32B (step S113). Note that when the detection temperatures of the two second sensors 32B are different, the correction of the rotation speed of the fixation motor 110 is performed based on higher one of the different detection temperatures.

As a result, the rotation speed of the fixation motor 110 is corrected to the rotation speed corresponding to the surface temperature of the second portion 31B (the portion having the largest outer diameter) of the pressure roller 31. The correction of the rotation speed in step S113 is performed until the completion of the fixing operation (step S114).

In this way, since the rotation speed of the fixation motor 110 is corrected using the detected temperature by the first sensors 32A (first temperature) and the detected temperature by the second sensors 32B (second temperature), the rotation speed of the fixation motor 110 can reflect the change in the outer diameter due to the thermal expansion of the pressure roller 31, and the surface speed of the pressure roller 31 can be kept constant.

Figure 20:
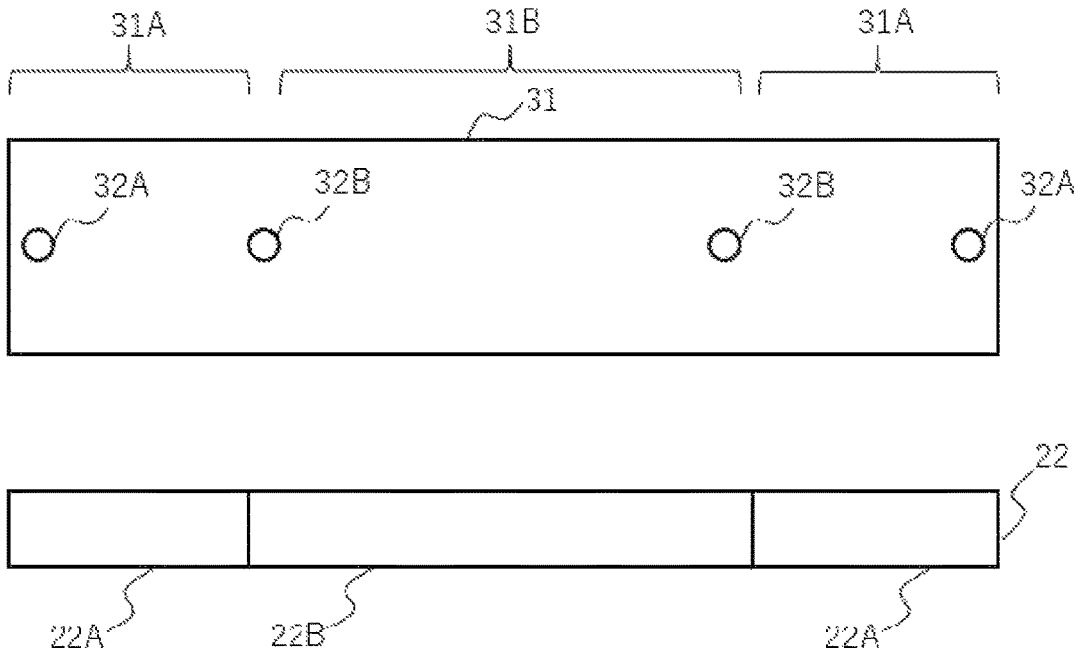
FIG. 20 is a diagram illustrating a schematic view of a positional relationship of a pressure roller, a heater, and sensors according to a first variation example of a first embodiment.
Figure 21:
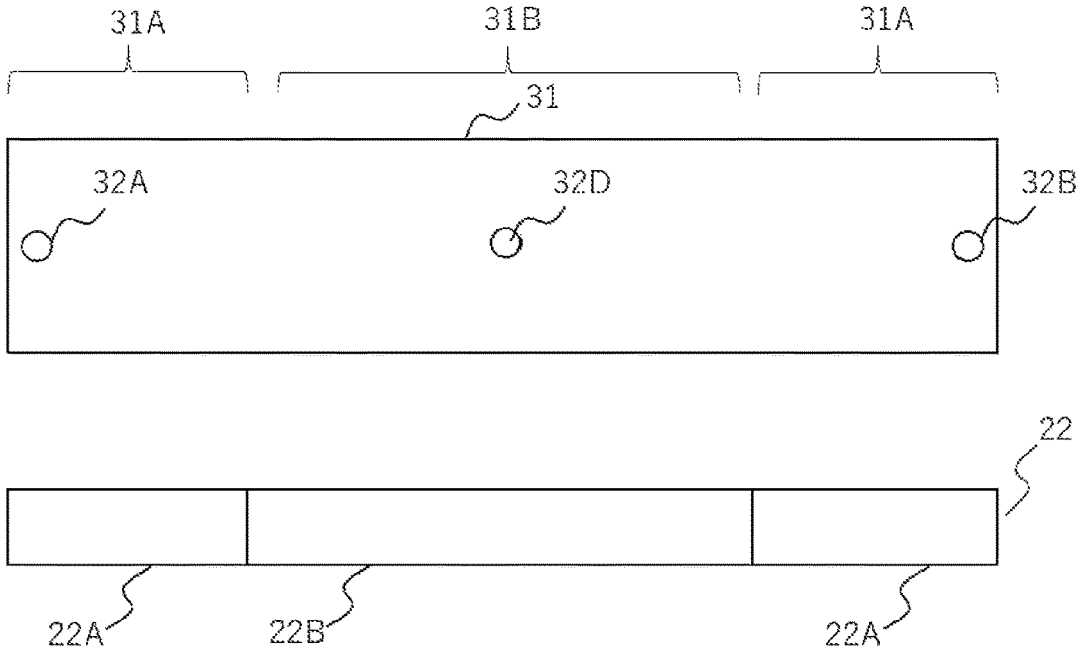
FIG. 21 is a diagram illustrating a schematic view of a positional relationship of a pressure roller, a heater, and sensors according to a second variation example of a first embodiment.

In a first embodiment described above, the pressure roller 31 has the concave crown shape; however, in the disclosure, the shape of the pressure roller 31 is not limited to such a concave crown shape. For example, the pressure roller 31 may have a cylindrical shape having an outer diameter substantially constant, such as being illustrated in FIG. 20 and FIG. 21. Here, the pressure roller 31 having the concave crown shape refers to one in which the difference between the outer diameter of the center portion and the outer diameter of the end portions is 0.07 mm or more. The pressure roller 31 having the cylindrical shape refers to one in which the difference between the outer diameter of the center portion and the outer diameter of the end portions is less than 0.07 mm.

Further in a first embodiment described above, the first heat generating portions 22A of the heater 22 are disposed at both end portions in the X-direction of the heater 22 and the second heat generating portion 22B is disposed at the middle portion in the X-direction of the heater 22; however, the disclosure is not limited to such an arrangement. For example, it is sufficient if the second heat generating portion 22B is disposed on a side closer to the center in the X-direction than the first heat generating portions 22A. The same applies to arrangements of the first regions 21A and the second region 21B of the fixation belt 21 and to arrangements of the first portions 31A and the second portion 31B of the pressure roller 31.

(Effects of First Embodiment)

As explained above, the fixation device 20 according to a first embodiment includes: the fixation belt 21 having the first region 21A and the second region 21B disposed closer to the center in the X-direction than the first region 21A; the first heat generating portion 22A that heats the first region 21A of the fixation belt 21; the second heat generating portion 22B that heats the second region 21B of the fixation belt 21; the first sensor 32A that detects the temperature of the end portion in the X-direction of the first portion 31A of the pressure roller 31 (i.e., the position corresponding to the end portion of the first heat generating portion 22A on the side of the end portion in the X-direction of the fixation belt 21), and the second sensor 32B that detects the temperature of the end portion in the X-direction of the second portion 31B of the pressure roller 31 (i.e., the position corresponding to the end portion of the second heat generating portion 22B on the side of the end portion in the X direction of the fixation belt 21). The controller 100 controls the drive speed of the pressure roller 31 according to the detection temperature of the first sensor 32A (first temperature) and the detection temperature of the second sensor 32B (second temperature).

Therefore, the pressure roller 31 can be driven at the drive speed (i.e., the rotation speed of the fixation motor 110) that reflects the change in the outer diameter of the pressure roller 31 due to the thermal expansion of the pressure roller 31. As a result, fluctuations in the surface speed (linear speed) of the pressure roller 31 can be suppressed, and image defects such as color shift and rubbing can be suppressed.

When the temperature difference (T2−T1) between the detection temperature of the first sensor 32A (first temperature) and the detection temperature of the second sensor 32B (second temperature) is less than the threshold value, the controller 100 controls the drive speed of the pressure roller 31 based on the detection temperature of the first sensor 32A (first temperature). If the temperature difference is equal or greater than the threshold value, the drive speed of the pressure roller 31 is controlled based on the detection temperature of the second sensor 32B (second temperature). Therefore, fluctuations in the surface speed of the pressure roller 31 can be suppressed no matter which portion of the pressure roller 31 has been expanded to have the largest outer diameter due to the thermal expansion.

Also, since the controller 100 switches between the fixation mode (first heating mode) in which both the first heat generating portion 22A and the second heat generating portion 22B are heated and the fixation mode (second heating mode) in which only the second heat generating portion 22B is heated according to the width of the medium P, energy can be saved when performing the fixing operation on the narrow medium P2 (when the medium P is the narrow medium P2).

When performing the fixing operation on the wide medium P1 (first heating mode), the controller 100 controls the drive speed of the pressure roller 31 according to the detection temperature of the first sensor 32A (first temperature). In the case where the pressure roller 31 has the concave crown shape, since the first portion 31A of the pressure roller 31 has the largest outer diameter in the first heating mode, the fluctuation of the surface speed of the pressure roller 31 can be suppressed by a simple process by using the detection temperature of the first sensors 32A.

On the other hand, when performing the fixing operation on the narrow medium P2 (second heating mode), the drive speed of the pressure roller 31 is controlled according to the detection temperature of the first sensor 32A (first temperature) and the detection temperature of the second sensor 32B (second temperature). In the case where the pressure roller 31 has the concave crown shape, the position having the largest outer diameter of the pressure roller 31 changes due to the thermal expansion with temperature in the second heating mode. Therefore, the fluctuation in the surface speed of the pressure roller 31 can be effectively suppressed, by using the detection temperatures of both of the first and second sensors 32A and 32B.

(First Modification)

Figure 17:
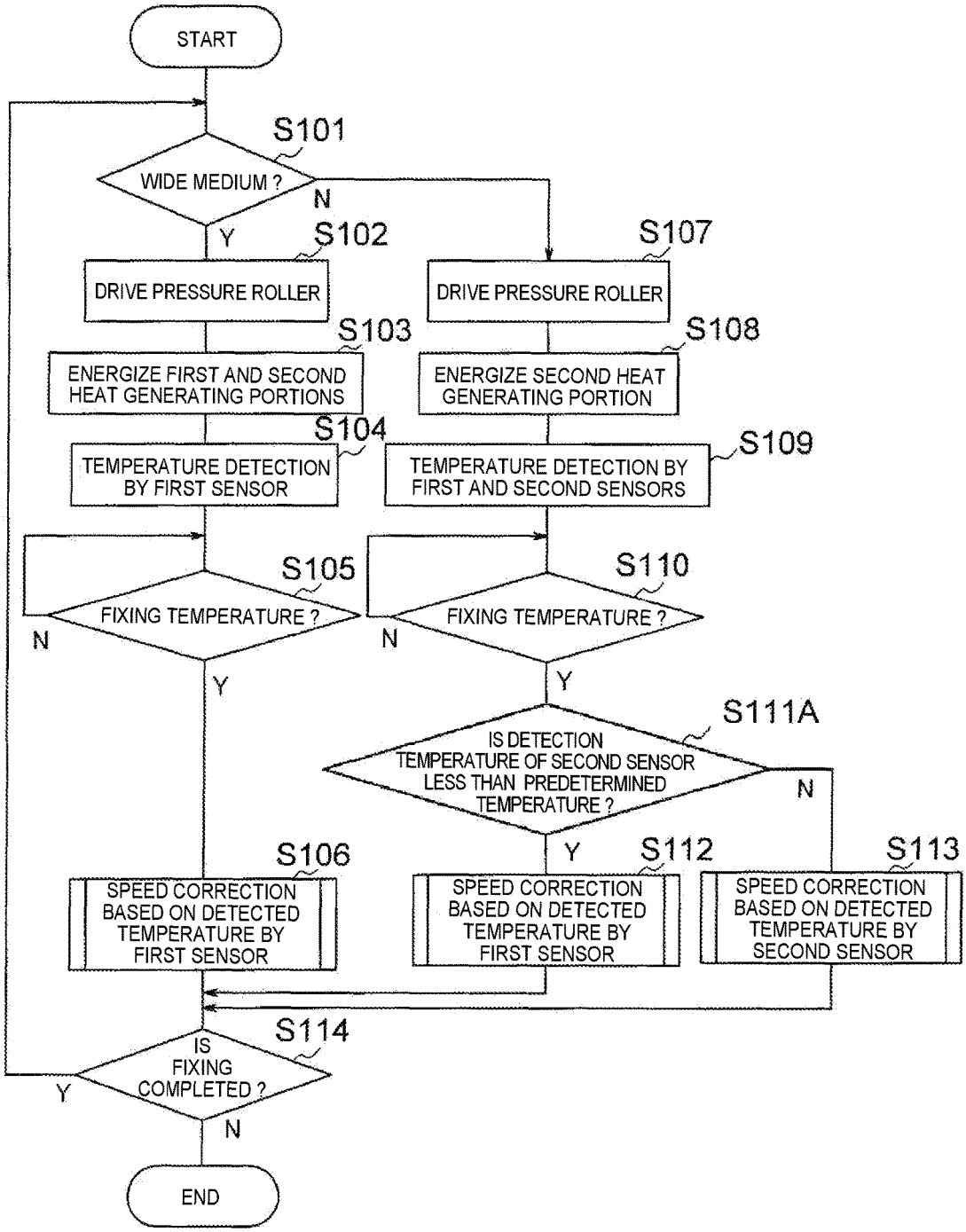
FIG. 17 is a flowchart illustrating a fixation operation according to a modification.

Next, a fixing operation according to a first modification of a first embodiment is described. FIG. 17 is a flowchart illustrating a fixing operation of the fixation device 20 according to first modification. The flowchart illustrated in FIG. 17 includes Step S111A in place of Step S111 in the flowchart illustrated in FIG. 16.

In a first embodiment described above, when performing the fixing operation on the narrow medium P2, the controller determines which one of the detection temperature of the first sensors 32A and the detection temperature of the second sensors 32B is used to correct the rotation speed of the fixation motor 110, based on the temperature difference (T2−T1) between the detection temperature (first temperature) of the first sensors 32A and the detection temperature (second temperature) of the second sensors 32B (in step S111 in FIG. 16).

As explained with reference to FIG. 13, it may be preferable to determine which one of the largest outer diameter D1 of the first portion 31A and the largest outer diameter D2 of the second portion 31B of the pressure roller 31 is greater based on the difference between the temperature detected by the first sensors 32A and the temperature detected by the second sensors 32B. However, when the detection temperature of the second sensors 32B is greater than a certain extent, the difference between the detection temperature of the first sensors 32A and the detection temperature of the first sensors 32B can be estimated to be greater than the threshold value.

Therefore, in this first modification, when performing the fixing operation on the narrow medium P2, if the detection temperature of the second sensors 32B (second temperature) is less than a predetermined temperature (Y in step S111A), the rotation speed of the fixation motor 110 is corrected based on the detection temperature of the first sensors 32A (step S112), and if the detection temperature of the second sensors 32B is equal or greater than the predetermined temperature (N in step S111A), the rotation speed of the fixation motor 110 is corrected based on the detection temperature of the second sensors 32B (step S113).

In this first modification, since the rotation speed of the fixation motor 110 is corrected using the detection temperature of the first sensors 32A in step S112, and the rotation speed of the fixation motor 110 is corrected using the detection temperature of the second sensors 32B in step S113, it is possible to effectively suppress the variation of the surface speed of the pressure roller 31.

Note that in this first modification, in step S111A in FIG. 17, it is determined whether the detection temperature of the second sensors 32B is less than the predetermined temperature. However, in the disclosure, in step S111A in FIG. 17, it may be determined whether the detection temperature of the first sensors 32A is less than a predetermined temperature.

(Second Modification)

Figure 18:
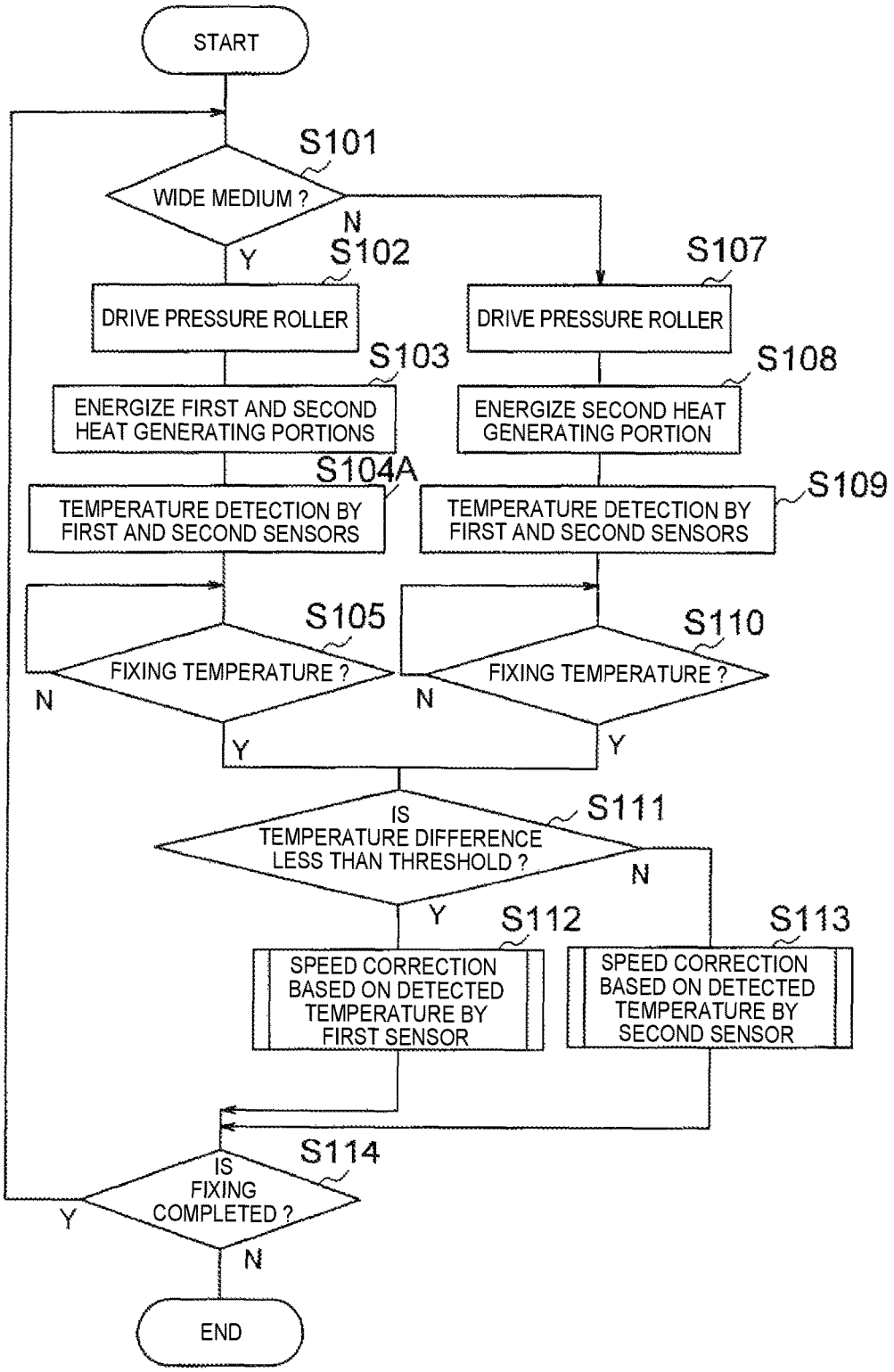
FIG. 18 is a flowchart illustrating a fixing operation according to another modification.

Next, a fixing operation according to a second modification of a first embodiment is described. FIG. 18 is a flowchart illustrating a fixing operation of the fixation device 20 according to a second modification. The flowchart illustrated in FIG. 18 includes step S104A in place of step S104 in the flowchart of FIG. 16, and the process proceeds to step S111 both in the case of Yes in step S105 and in the case of Yes in step S110, and step S106 has been deleted.

In a first embodiment described above, the temperatures are detected by the first sensors 32A and the second sensors 32B only in the second heating mode (when the medium P is the narrow medium P2), to control the drive speed based on the detection temperature of the first sensors 32A and the detection temperature of the second sensors 32B. However, in this second modification illustrated in FIG. 18, the temperatures are detected by both the first sensors 32A and the second sensors 32B also in the first heating mode (when the medium P is the wide medium P1) as well as in the second heating mode (when the medium P is the narrow medium P2), to control the drive speed based on the detection temperature of the first sensors 32A and the detection temperature of the second sensors 32B.

Specifically, even when the medium P is the wide medium P1 (Y in step S101), after steps S102 and S103, the controller 100 detects the surface temperature of the pressure roller 31 both by the first sensors 32A and by the second sensors 32B (step S104A).

After the detection temperature of the first sensors 32A and the detection temperature of the second sensors 32B reach the predetermined fixing temperature (step S105), the controller 100 determines whether the difference in the detection temperature of the first sensors 32A and the detection temperature of the second sensors 32B is less than the threshold value (step S111), and then performs the correction of the rotation speed in step S112 or step S113.

According to such a second modification, even when the medium P is the wide medium P1 (even in the first heating mode), if the temperature of the second portion 31B (the center portion in the X-direction) of the pressure roller 31 (e.g., the detection temperature of the second sensors 32B) becomes higher than the temperature of the first portions 31A (both end portions in the X-direction) of the pressure roller 31 (e.g., the detection temperature of the first sensors 32A) and thus the pressure roller 31 has the largest outer diameter at the second portion 31B (the central portion in the X direction) due to the thermal expansion, the rotation speed of the fixation motor 110 can be properly corrected.

Figure 22:
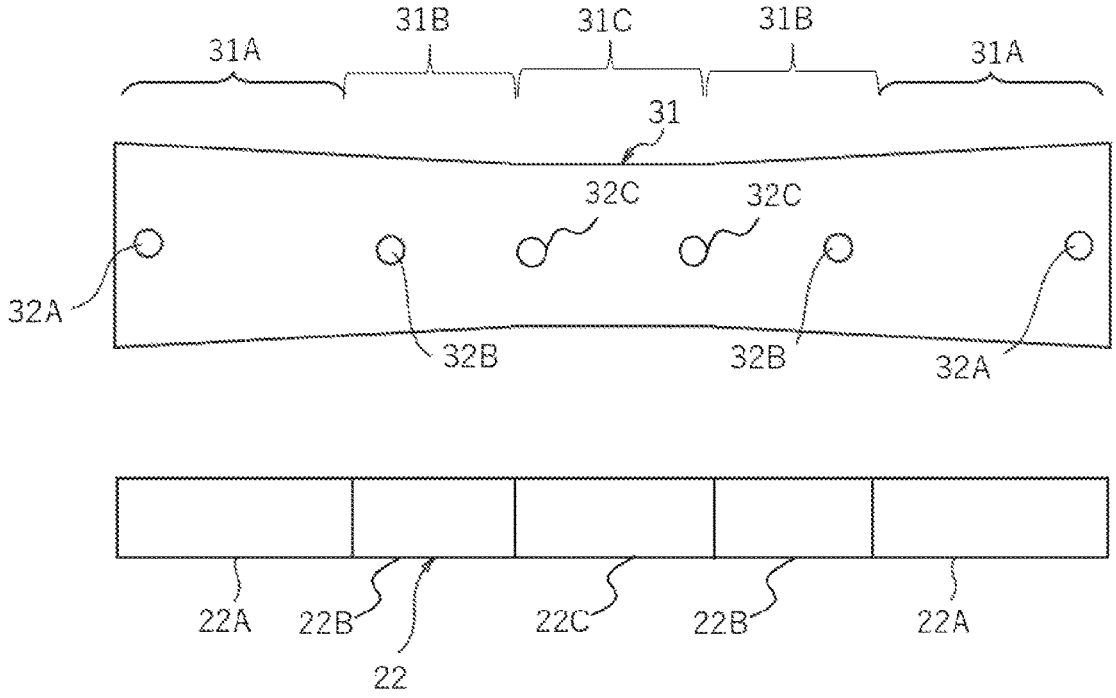
FIG. 22 is a diagram illustrating a schematic view of a positional relationship of a pressure roller, a heater, and sensors according to a third variation example of a first embodiment.
Figure 23:
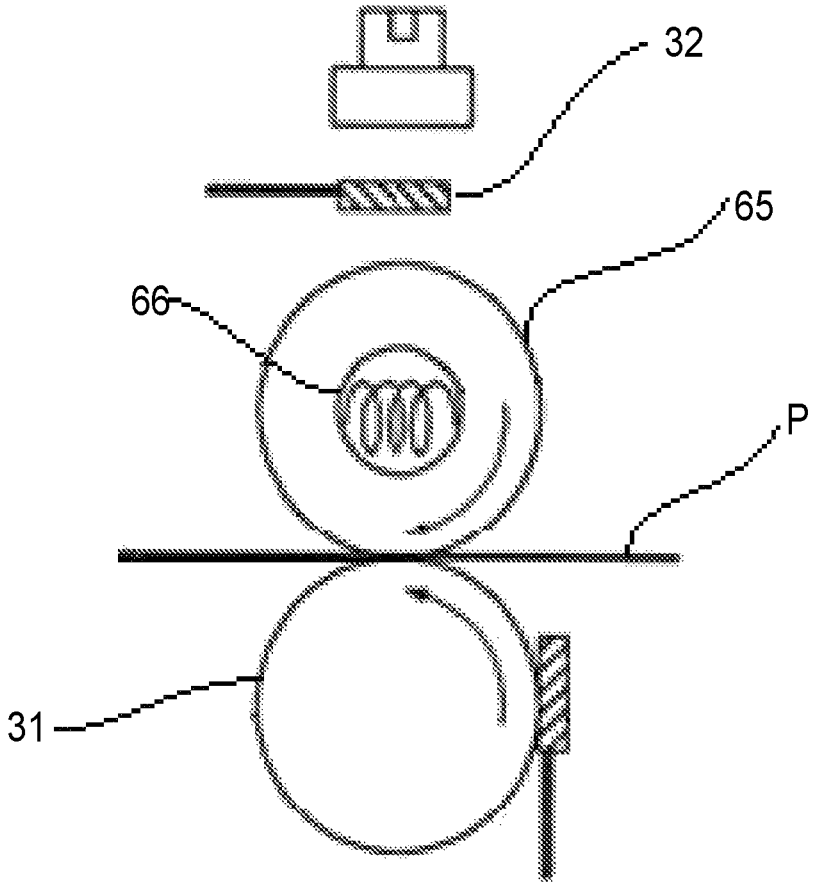
FIG. 23 is a diagram illustrating a perspective view of a fixation device according to a modification.

For example, when the medium is such a wide medium that overlaps with the first sensors 32A, it may happen that the first temperature becomes smaller than the second temperature at both end portions of the pressure roller 31 because the heat is not only taken by the wide medium but also leaks (radiates) from both ends of the pressure roller 31. Even in such a case, the conveyance speed of the medium can be corrected based on the location where the outer diameter is the largest due to the thermal expansion. In particular, in a case where the pressure roller 31 has the cylindrical shape (see FIG. 21 and FIG. 22) or a fixation roller 51 or 65 (described later, see FIG. 19 and FIG. 23) has a cylindrical shape, the probability that the center or middle portion thereof becomes the largest outer diameter due to the thermal expansion is high, and therefore it is particularly effective to apply the fixing operation of the second modification in such a structure.

Second Embodiment

Figure 19:
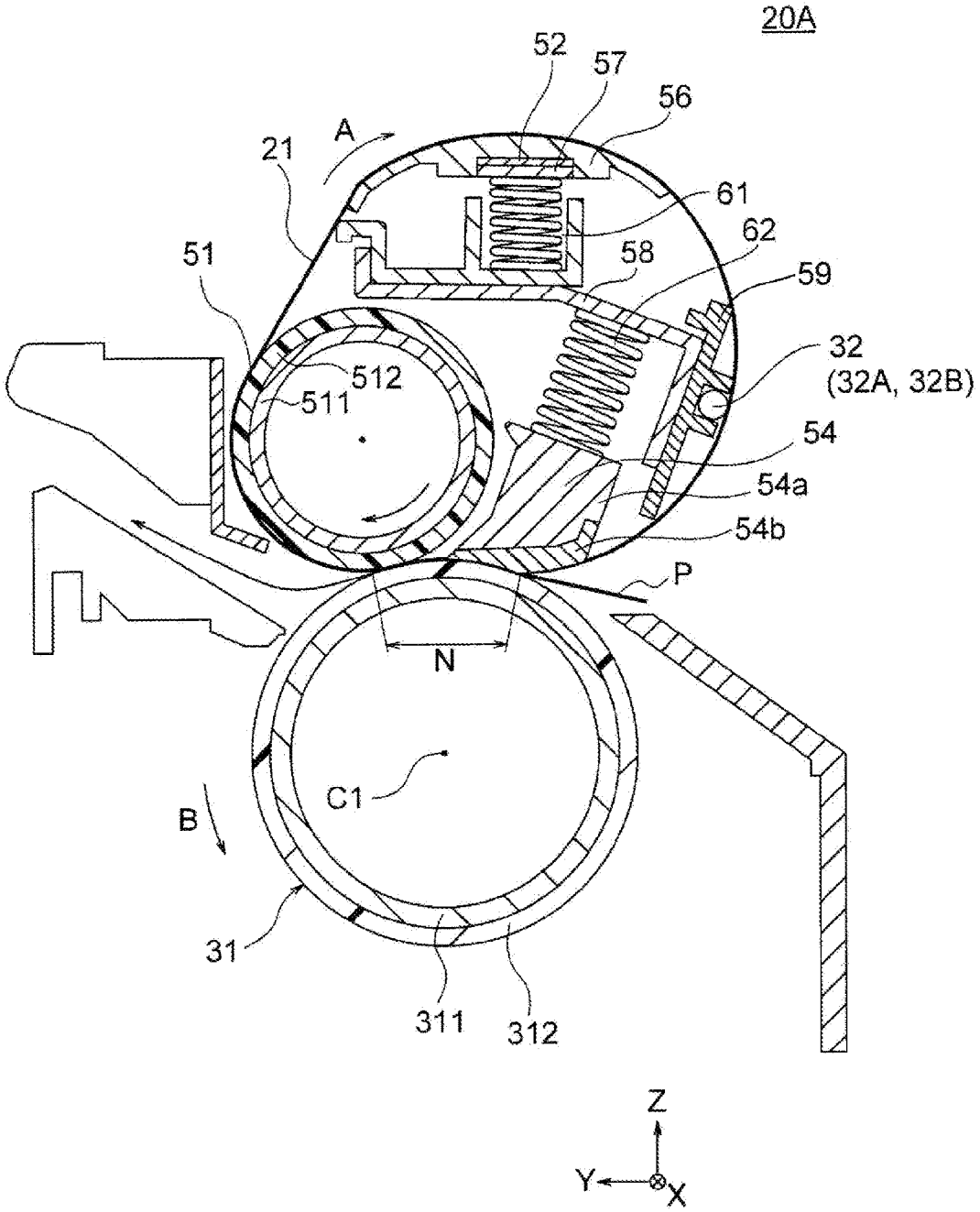
FIG. 19 is a diagram illustrating a view of a fixation device of a second embodiment.

Next, a second embodiment is described. FIG. 19 is a diagram illustrating a view of a fixation device 20A according to a second embodiment. In the fixation device 20A according to a second embodiment, a fixation roller 51 is disposed on a side of an inner circumferential surface of a fixation belt 21, and the fixation belt 21 is driven by the fixation roller 51. The pressure roller 31 functions as a driven roller.

As illustrated in FIG. 19, the fixation device 20A includes the fixation belt 21 (belt member) serving as a fixation member, the fixation roller 51, a heater 52 serving as a heat generating member, a temperature detector 32, a pressure pad 54, a heat transfer member 56, and the pressure roller 31 serving as a pressurizing member.

The fixation belt 21 according to a second embodiment is configured in a same or similar manner as the fixation belt 21 according to a first embodiment. The heater 52 according to a second embodiment is configured in a same or similar manner as the heater 22 according to a first embodiment. However, the heater 52 is in contact with the inner circumferential surface of the fixation belt 21 on the opposite side from the nip portion N.

The heat transfer member 56 is disposed between the heater 52 and the fixation belt 21, guides the fixation belt 21 from the inner circumference side, and transfers the heat of the heater 52 to the fixation belt 21. The heat transfer member 56 has a recessed portion accommodating the heater 52 on the side opposite to the side guiding the fixation belt 21.

A pressure plate 57 is disposed in the recess of the heat transfer member 56 so as to contact a back surface of the heater 52. A spring 61 is provided between the pressure plate 57 and a support member 58 attached to the fixed frame 35 (see FIG. 3) of the fixation device 20A. The spring 61 biases the heat transfer member 56 toward the fixation belt 21 via the pressure plate 57.

The fixation roller 51 is in contact with the inner circumferential surface of the fixation belt 21. The fixation roller 51 has an axial direction thereof extending in the X direction. Specifically, the fixation roller 51 includes a shaft 511 and an elastic layer 512 covering the surface of the shaft 511. The shaft 511 is formed of, for example, aluminum, and the elastic layer 512 is formed of, for example, silicone rubber.

Both end portions of the shaft 511 in the X direction are supported by bearings provided in the side plate 35*b* of the fixed frame 35 (see FIG. 3). The driving force of the fixation motor 110 (see FIG. 9) is transmitted to one end (axle portion) of the shaft 511 in the X direction.

The pressure pad 54 is in contact with the inner circumferential surface of the fixation belt 21. The pressure pad 54 is disposed on the upstream side of the fixation roller 51 in the movement direction of the fixation belt 21. The pressure pad 54 is pressed in a direction of contacting the pressure roller 31 by a spring 62 attached to the support member 58 described above.

The pressure pad 54 has a main body portion 54*a* and an elastic body 54*b* provided on the fixation belt 21 side of the main body portion 54*a*. The body 54*a* is formed of, for example, metal or resin, and the elastic body 54*b* is formed of, for example, silicone rubber. The elastic body 54*b* is pressed against the pressure roller 31 via the fixation belt 21.

The pressure roller 31 forms the nip portion N between the fixation roller 51 and the pressure pad 54. The pressure roller 31 according to a second embodiment is configured in a same or similar manner as the pressure roller 31 according to a first embodiment. However, the pressure roller 31 according to a second embodiment does not rotate by itself, but is rotated by the rotation of the fixation belt 21.

The temperature detector 32 is disposed so as to be in contact with the inner circumferential surface of the fixation belt 21. The temperature detector 32 is disposed downstream of the heat transfer member 56 and upstream of the pressure pad 54 in the movement direction of the fixation belt 21. A guide member 59 which guides the fixation belt 21 from the inner circumference side is attached to the support member 58, and the temperature detector 32 is held in the guide member 59.

The temperature detector 32 includes the first sensors 32A and the second sensors 32B which are thermistors. The arrangement of the sensors 32A and 32B in the X direction is the same as that of the sensors 32A and 32B of a first embodiment (FIG. 8). The first sensors 32A and the second sensors 32B detect the surface temperature of the fixation belt 21 and output detected temperature information to the fixation controller 105 (FIG. 9).

In a second embodiment, the drive speed of the fixation motor 110 is corrected according to the detection temperature of the first sensors 32A (first temperature) and the detection temperature of the second sensors 32B (second temperature). The rotation speed of the fixation motor 110 corresponds to the drive speed of the fixation roller 51 and also to the drive speed of the fixation belt 21.

The fixing operation of the fixation device 20A according to a second embodiment is as described with reference to the flowchart of FIG. 16. The method of correcting the rotation speed of the fixation motor 110 in a second embodiment is also as described with reference to FIGS. 14 and 15, except that the driving object of the fixation motor 110 is the fixation roller 51.

In a second embodiment, the fixation motor 110 can be rotated at the rotation speed corrected in response to the change in the outer diameter of the pressure roller 31 due to the thermal expansion. In other words, the fixation belt 21 can be driven at the rotation speed corrected in response to the change in the outer diameter of the pressure roller 31 due to the thermal expansion. That is, the rotational speed of the fixation motor 110 is corrected so as to suppress the fluctuation of the surface speed (linear speed) of the pressure roller 31. As a result, image defects such as color shift and rubbing can be suppressed.

In a second embodiment, the temperature of the inner circumferential surface of the fixation belt 21 is detected by the temperature detector 32 (the sensors 32A and 32B), but the surface temperature of the pressure roller 31 may be detected as in a first embodiment.

In a second embodiment, the fixing operation illustrated in FIG. 17 or the fixing operation illustrated in FIG. 18 may be performed.

Third Embodiment

In first and second embodiments described above, the cases have been described in which the fixation device 20 (FIG. 2) and the fixation device 20A (FIG. 19) use the fixation belt 21. However, the disclosure is not limited thereto. For example, like a third embodiment illustrated in FIG. 23, a fixation device 20B may not includes a fixation belt. The fixation device 20B according to a third embodiment includes the pressure roller 31 and a fixation roller 65 in which a heater (e.g., a halogen lamp) is arranged inside are arranged opposite each other to form a nip portion N therebetween. In such a fixation device 20B according to a third embodiment, the same or similar effects as those of first and second embodiments and modifications described above can be obtained.

In the second and third embodiments described above, the fixation roller 51, 65 may be a concave crown shape or a cylindrical shape.

(Variation Examples)

In an embodiment described above, the case has been described in which the speed of the pressure roller 31 is controlled based on the detection temperature of the first sensors 32A and the detection temperature of the second sensors 32B; however, the disclosure is not limited thereto.

For example, the speed of the fixation roller 51 or 65 may be corrected (controlled) based on the detection temperature of the first sensors 32A and the detection temperature of the second sensors 32B.

Further, in an embodiment described above, the case has been described in which the two first sensors 32A and the two second sensors 32B are provided; however, the disclosure is not limited thereto. For example, at least one first sensor and at least one second sensor may be provided, or only one first sensor and only one second sensor may be provided. In a variation example illustrated in FIG. 21, only one second sensor 32D and two first sensors 32A are provided in such a manner that the second sensor 32D is provided at a position corresponding to the center of the pressure roller 31 (the center of the second portion 31B of the pressure roller 31) in the X direction.

In an embodiment described above, the case has been described in which the heater 22 is divided into three regions having the two first heat generating portions 22A and the one second heat generating portion 22B. However, the disclosure is not limited thereto. For example, like a variation example illustrated in FIG. 22, the heater 22 may be divided into five regions. In a variation example illustrated in FIG. 22, in a case where regions 22B are the first heat generating portions and a region 22C is the second heat generating portion, elements 32B correspond to the first sensors and elements 32C correspond to the second sensors. Also, in a variation example illustrated in FIG. 22, in a case where regions 22A are the first heat generating portions and a region 22C is the second heat generating portion, elements 32A correspond to the first sensors and elements 32C correspond to the second sensors. In a variation example illustrated in FIG. 22, in a case where regions 22A are the first heat generating portions and regions 22B are the second heat generating portions, elements 32A correspond to the first sensors and elements 32B correspond to the second sensors.

In an embodiment described above, the case has been described in which the image formation apparatus forms color images. However, the invention can also be applied to an image formation apparatus that forms monochrome (black and white) images. Further, the invention can be applied to a fixation device and an image formation apparatus of various types (for example, a copying machine, a facsimile machine, a printer, a multifunction circumferential, etc.) that forms an image on a medium by using an electrophotographic method.

The invention includes other embodiments or modifications in addition to one or more embodiments, modifications, and variation examples described above without departing from the spirit of the invention. The one or more embodiments, modifications, and variation examples described above are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising: a fixation device; and a controller, wherein the fixation device includes:

a fixation member that is configured to transfer heat to a medium and includes a first region, and a second region that is located closer to a center in a longitudinal direction of the fixation member than the first region;

a pressurizing member that forms a nip portion between the fixation member and the pressurizing member;

a first heat generating portion configured to heat the first region of the fixation member;

a second heat generating portion configured to heat the second region of the fixation member;

a first sensor that detects a first temperature of the pressurizing member at a position corresponding to the first region in the longitudinal direction; and a second sensor that detects a second temperature of the pressurizing member at a position corresponding to the second region in the longitudinal direction, the controller is configured to control a drive speed of the pressurizing member based on the first temperature and the second temperature, a third region of the pressurizing member facing the second region of the fixation member is formed such that an outer diameter of an end portion of the third region in the longitudinal direction is greater than an outer diameter of a center portion of the third region in the longitudinal direction, and the second sensor is provided at a position facing the end portion of the third region of the pressurizing member in the longitudinal direction.

2. The image formation apparatus according claim 1, wherein the first sensor is provided at a position corresponding to an end portion of the first heat generating portion on a side of an end portion of the fixation member in the longitudinal direction.

3. The image formation apparatus according claim 1, wherein the controller is configured to switch, according to a width of the medium, between a first heating mode in which both the first heat generating portion and the second heat generating portion are heated and a second heating mode in which only the second heat generating portion is heated.

4. The image formation apparatus according claim 3, wherein the controller is configured, in the second heating mode, to control the drive speed based on the first temperature, when a value obtained by subtracting the first temperature from the second temperature is less than a threshold value; and control the drive speed based on the second temperature, when the value obtained by subtracting the first temperature from the second temperature is not less than the threshold value.

5. The image formation apparatus according claim 3, wherein the controller is configured, in the second heating mode, to:

control the drive speed based on the first temperature, when at least one of the first temperature and the second temperature is less than a predetermined temperature; and control the drive speed based on the second temperature, when the at least one of the first temperature and the second temperature is not less than the predetermined temperature.

6. The image formation apparatus according claim 1, wherein the controller is configured to:

when controlling the drive speed based on the first temperature, decelerate the drive speed as the first temperature increases and accelerate the drive speed as the first temperature decreases; and when controlling the drive speed based on the second temperature, decelerate the drive speed as the second temperature increases and accelerate the drive speed as the second temperature decreases.

7. The image formation apparatus according claim 1, further comprising a driver configured to drive the pressurizing member, wherein the controller is configured to control the drive speed of the pressurizing member or the fixation member by controlling the driver.

8. The image formation apparatus according claim 1, wherein the first region is located at an end portion of the fixation member in the longitudinal direction, and the second region is located in a middle portion of the fixation member in the longitudinal direction.

9. The image formation apparatus according claim 1, wherein the pressurizing member is a pressure roller having an axial direction thereof parallel to the longitudinal direction of the fixation member.

10. The image formation apparatus according claim 9, wherein the pressure roller has the axial direction thereof parallel to the longitudinal direction of the fixation member in such a manner that an outer diameter of an end portion of the pressure roller in the axial direction is greater than an outer diameter of a middle portion of the pressure roller in the axial direction.

11. The image formation apparatus according claim 1, wherein the fixation member is an endless belt member, and the first heat generating portion and the second heat generating portion are provided on an inner circumferential surface side of the belt member.

12. The image formation apparatus according claim 11, further comprising a fixation roller provided on the inner circumferential surface side of the belt member, wherein the belt member is driven to rotate by a rotation of the fixation roller.

13. The image formation apparatus according claim 1, wherein the fixation member is a fixation roller formed with a hollow therein, and the first heat generating portion and the second heat generating portion are provided in the hollow of the fixation member.

14. The image formation apparatus according claim 1, further comprising:

a media supply unit configured to supply the medium; and an image formation unit configured to form an image on the medium supplied from the media supply unit, wherein the medium that has passed through the image formation unit is conveyed to the fixation device.

15. The image formation apparatus according claim 1, wherein the fixation member is an endless belt member, and the first heat generating portion and the second heat generating portion comprise plate-shaped heating elements on an inner circumferential surface side of the belt member.

16. The image formation apparatus according claim 1, wherein the fixation member is an endless belt member, and the belt member is driven to rotate by a rotation of the pressurizing member.

17. An image formation apparatus comprising: a fixation device; and a controller, wherein the fixation device includes:

a fixation member that is configured to transfer heat to a medium and includes a first region, and a second region located closer to a center in a longitudinal direction of the fixation member than the first region;

a pressurizing member that forms a nip portion between the fixation member and the pressurizing member;

a first heat generating portion configured to heat the first region of the fixation member;

a second heat generating portion configured to heat the second region of the fixation member;

a first sensor that detects a first temperature of the pressurizing member at a position corresponding to the first region in the longitudinal direction; and a second sensor that detects a second temperature of the pressurizing member at a position corresponding to the second region in the longitudinal direction, the controller is configured to control a drive speed of the pressurizing member or the fixation member based on the first temperature and the second temperature, the controller is configured to:

in response to determining that a value obtained by subtracting the first temperature from the second temperature is less than a threshold value, control the drive speed based on the first temperature only; and in response to determining that the value obtained by subtracting the first temperature from the second temperature is not less than the threshold value, control the drive speed based on the second temperature only.

18. The image formation apparatus according claim 17, wherein the pressurizing member is a pressure roller having an axial direction thereof parallel to the longitudinal direction of the fixation member in such a manner that an outer diameter of an end portion of the pressure roller in the axial direction is greater than an outer diameter of a middle portion of the pressure roller in the axial direction.

19. An image formation apparatus comprising: a fixation device; and a controller, wherein the fixation device includes:

a fixation member that is configured to transfer heat to a medium and includes a first region, and a second region located closer to a center in a longitudinal direction of the fixation member than the first region;

a pressurizing member that forms a nip portion between the fixation member and the pressurizing member;

a first heat generating portion configured to heat the first region of the fixation member;

a second heat generating portion configured to heat the second region of the fixation member;

a first sensor that detects a first temperature of the pressurizing member at a position corresponding to the first region in the longitudinal direction; and a second sensor that detects a second temperature of the pressurizing member at a position corresponding to the second region in the longitudinal direction, the controller is configured to control a drive speed of the pressurizing member or the fixation member based on the first temperature and the second temperature, the controller is configured to, in response to determining that the second temperature is less than the first temperature, control the drive speed based on the first temperature only, and the controller is configured to, in response to determining that the second temperature is not less than the first temperature, control the drive speed based on the second temperature only.

20. The image formation apparatus according claim 19, wherein the pressurizing member is a cylindrical pressure roller having an axial direction thereof parallel to the longitudinal direction of the fixation member.

* * * * *